US009074454B2

(12) United States Patent
Crick et al.

(10) Patent No.: US 9,074,454 B2
(45) Date of Patent: Jul. 7, 2015

(54) DYNAMIC RESERVOIR ENGINEERING

(75) Inventors: Martin Crick, Abingdon (GB); Simon Bulman, Bicester (GB); Colm O'Halloran, Kerry (IE); Peter Wardell-Yerburgh, Appleton (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 1543 days.

(21) Appl. No.: 12/350,725

(22) Filed: Jan. 8, 2009

(65) Prior Publication Data

US 2009/0182541 A1 Jul. 16, 2009

Related U.S. Application Data

(60) Provisional application No. 61/021,287, filed on Jan. 15, 2008.

(51) Int. Cl.

| | |
|---|---|
| ***G06G 7/48*** | (2006.01) |
| ***E21B 43/00*** | (2006.01) |
| ***E21B 49/00*** | (2006.01) |

(52) U.S. Cl.

CPC ..... *E21B 43/00* (2013.01); *E21B 49/00* (2013.01)

(58) Field of Classification Search

USPC ..... 703/10

See application file for complete search history.

(56) References Cited

U.S. PATENT DOCUMENTS 5,311,951 A 5/1994 Kyte 5,386,568 A 1/1995 Wold et al.

(Continued)

FOREIGN PATENT DOCUMENTS

| | | |
|---|---|---|
| EP | 2431767 | 3/2012 |
| GB | 2448016 | 10/2008 |

(Continued)

OTHER PUBLICATIONS

Eric Cayeux et al., "Well Planning Quality Improved Using Cooperation Between Drilling and Geosciences," Society of Petroleum Engineers Paper No. 71331, 2001, Society of Petroleum Engineers, pp. 1-9.*

(Continued)

*Primary Examiner* — Kamini S Shah
*Assistant Examiner* — Russ Guill
(74) *Attorney, Agent, or Firm* — Colin L. Wier; Rodney Warfford

(57) ABSTRACT

An example method for performing reservoir engineering includes generating a geological model of a reservoir including a geological horizon, obtaining an offset relative to the geological horizon, and positioning a wellbore equipment item in a well completion design based on the offset. The method further includes calculating an absolute position of the wellbore equipment item in the well completion design based on the offset and a location of the geological horizon in the geological model and updating the geological model to generate an updated location of the geological horizon. The method further includes updating the absolute position of the wellbore equipment item in the well completion design based on the offset and the updated location of the geological horizon and simulating a simulation case including the geological model and the well completion design after updating the absolute position of the wellbore equipment item.

16 Claims, 16 Drawing Sheets

(56) References Cited

U.S. PATENT DOCUMENTS

| | | | | |
|---|---|---|---|---|
| 5,444,619 | A | 8/1995 | Hoskins et al. | |
| 5,740,342 | A * | 4/1998 | Kocberber | 345/420 |
| 5,992,519 | A | 11/1999 | Ramakrishnan et al. | |
| 6,069,118 | A | 5/2000 | Hinkel | |
| 6,078,869 | A | 6/2000 | Gunasekera et al. | |
| 6,106,561 | A | 8/2000 | Farmer et al. | |
| 6,108,497 | A | 8/2000 | Nakayama et al. | |
| 6,138,076 | A * | 10/2000 | Graf et al. | 702/14 |
| 6,230,101 | B1 | 5/2001 | Wallis | |
| 6,283,212 | B1 | 9/2001 | Hinkel | |
| 6,313,837 | B1 | 11/2001 | Assa et al. | |
| 6,350,721 | B1 | 2/2002 | Fu | |
| 6,660,693 | B2 | 12/2003 | Miller | |
| 6,668,922 | B2 | 12/2003 | Ziauddin | |
| 6,705,398 | B2 | 3/2004 | Weng | |
| 6,749,022 | B1 | 6/2004 | Fredd | |
| 6,980,940 | B1 | 12/2005 | Gurpinar et al. | |
| 6,989,103 | B2 | 1/2006 | Mohsen | |
| 7,069,148 | B2 | 6/2006 | Thambynayagam et al. | |
| 7,164,990 | B2 | 1/2007 | Bratvedt et al. | |
| 7,165,621 | B2 | 1/2007 | Ayoub | |
| 7,224,080 | B2 | 5/2007 | Smedstad | |
| 7,248,259 | B2 | 7/2007 | Fremming et al. | |
| 7,258,175 | B2 | 8/2007 | Veeningen et al. | |
| 7,424,415 | B2 * | 9/2008 | Vassilev | 703/10 |
| 7,478,024 | B2 | 1/2009 | Gurpinar et al. | |
| 7,523,024 | B2 | 4/2009 | Endres et al. | |
| 7,542,037 | B2 | 6/2009 | Fremming et al. | |
| 7,546,228 | B2 | 6/2009 | Cullick et al. | |
| 7,561,998 | B2 | 7/2009 | Panga | |
| 7,617,082 | B2 | 11/2009 | Childs | |
| 7,699,561 | B2 | 4/2010 | McCann | |
| 7,726,402 | B2 | 6/2010 | Ramakrishnan | |
| 7,763,099 | B2 | 7/2010 | Verma | |
| 7,778,859 | B2 | 8/2010 | Bouzas | |
| 7,806,182 | B2 | 10/2010 | Waters | |
| 7,819,168 | B2 | 10/2010 | Auzerais | |
| 7,819,191 | B2 | 10/2010 | Miller | |
| 2003/0132934 | A1 | 7/2003 | Fremming | |
| 2003/0216897 | A1 | 11/2003 | Endres et al. | |
| 2005/0149037 | A1 | 7/2005 | Steffensmeier et al. | |
| 2005/0171698 | A1 | 8/2005 | Sung et al. | |
| 2006/0006656 | A1 | 1/2006 | Smedstad | |
| 2006/0129366 | A1 | 6/2006 | Shaw | |
| 2006/0167669 | A1 | 7/2006 | Cariveau et al. | |
| 2006/0184329 | A1 | 8/2006 | Rowan et al. | |
| 2006/0197759 | A1 | 9/2006 | Fremming | |
| 2006/0282243 | A1 | 12/2006 | Childs | |
| 2007/0061087 | A1 | 3/2007 | Ghorayeb et al. | |
| 2007/0112547 | A1 | 5/2007 | Ghorayeb et al. | |
| 2007/0227732 | A1 | 10/2007 | Miller | |
| 2007/0276639 | A1 * | 11/2007 | Montaron et al. | 703/10 |
| 2007/0280047 | A1 * | 12/2007 | MacGregor et al. | 367/15 |
| 2008/0047326 | A1 | 2/2008 | McCann | |
| 2008/0073082 | A1 | 3/2008 | Thiercelin | |
| 2008/0126048 | A1 * | 5/2008 | Labourdette | 703/9 |
| 2008/0239871 | A1 * | 10/2008 | Thevoux-Chabuel | 367/27 |
| 2008/0288226 | A1 * | 11/2008 | Gurpinar et al. | 703/10 |
| 2008/0300793 | A1 | 12/2008 | Tilke et al. | |
| 2009/0043507 | A1 * | 2/2009 | Dommisse et al. | 702/6 |
| 2009/0089028 | A1 | 4/2009 | Sagert | |
| 2009/0151559 | A1 | 6/2009 | Verma | |
| 2009/0159272 | A1 | 6/2009 | Auzerais | |
| 2009/0182541 | A1 | 7/2009 | Crick et al. | |
| 2009/0182694 | A1 | 7/2009 | Boulatsel | |
| 2009/0211755 | A1 | 8/2009 | Dyer | |
| 2010/0000737 | A1 | 1/2010 | Ramakrishnan | |
| 2010/0082375 | A1 | 4/2010 | Vivalda | |
| 2010/0084131 | A1 | 4/2010 | Bouzas | |
| 2010/0116511 | A1 | 5/2010 | Ramakrishnan | |
| 2010/0226837 | A1 | 9/2010 | Carlton | |
| 2011/0060572 | A1 | 3/2011 | Brown et al. | |

FOREIGN PATENT DOCUMENTS

| | | |
|---|---|---|
| WO | 99/52048 | 10/1999 |
| WO | 99/64896 | 12/1999 |
| WO | 2004049216 | 6/2004 |
| WO | 2006/053294 | 5/2006 |

OTHER PUBLICATIONS

H. Thevoux-Chabuel et al., "Geosteering Diagnosis: A New Approach to Monitor the Well Position Within a 3D Geological Model," Society of Petroleum Engineers Paper No. 102602, 2006, Society of Petroleum Engineers, pp. 1-10.*

"Modeling While Drilling," 2007, Schlumberger, Middle East & Asia Review, No. 8, pp. 22-35.*

Canadian Intellectual Property Office Examination Report for Canadian Patent Application No. 2,649,439 dated Feb. 23, 2012.

Cayeux, "Well Planning Quality Improved Using Cooperation between Drilling and Geosciences", Society of Petroleum Engineers: Paper No. 71331, pp. 1-9, 2001.

* cited by examiner

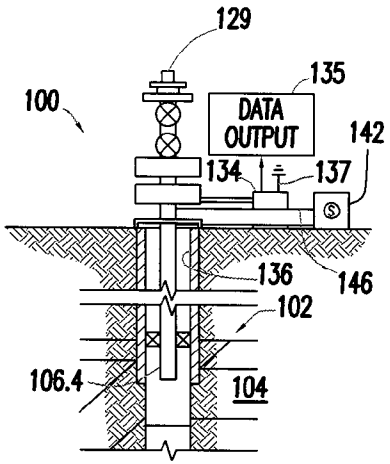
FIG. 1.4
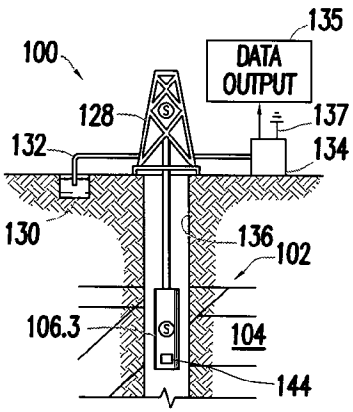
FIG. 1.3
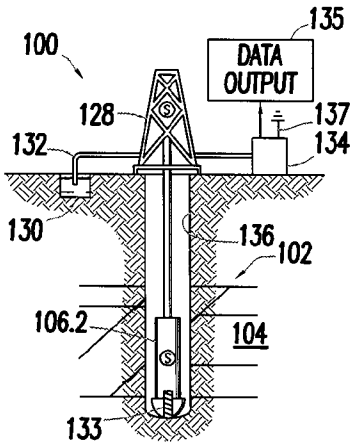
FIG. 1.2
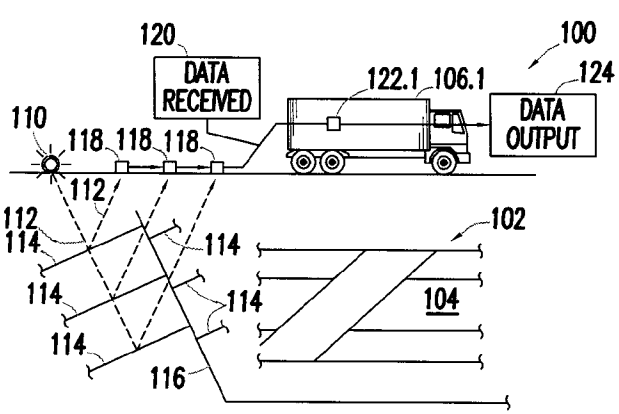
FIG. 1.1
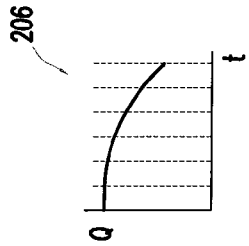
FIG. 2.4
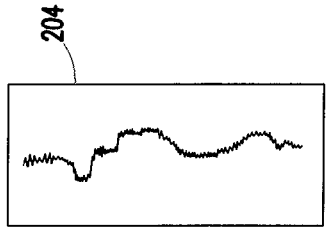
FIG. 2.3
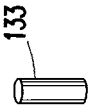
FIG. 2.2
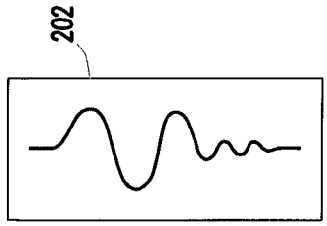
FIG. 2.1

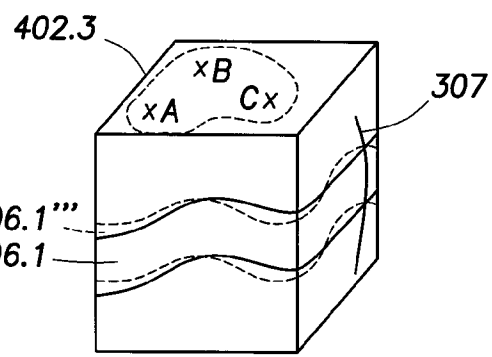
FIG.4.3
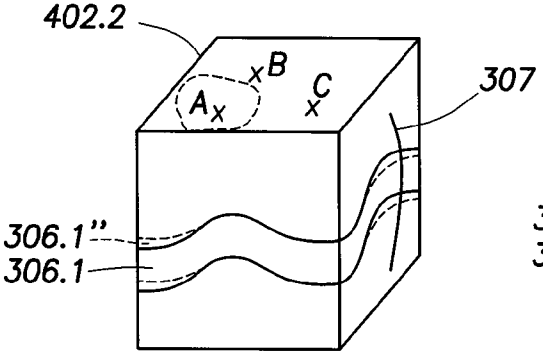
FIG.4.2
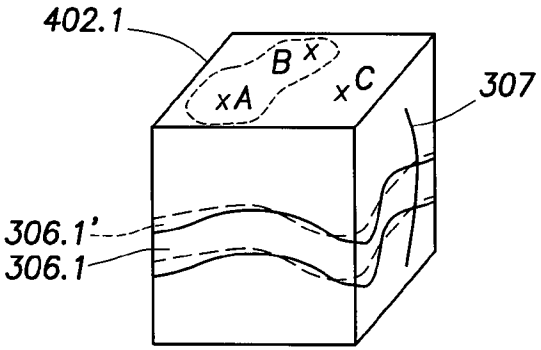
FIG.4.1
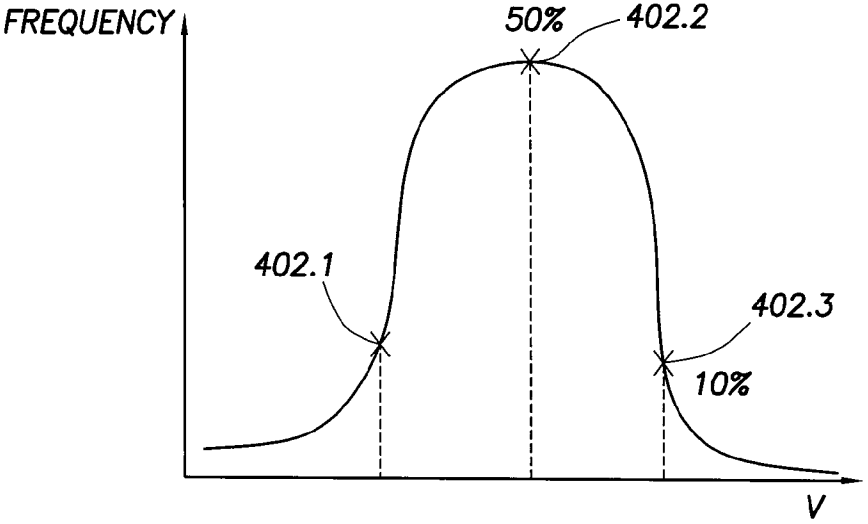
FIG.5

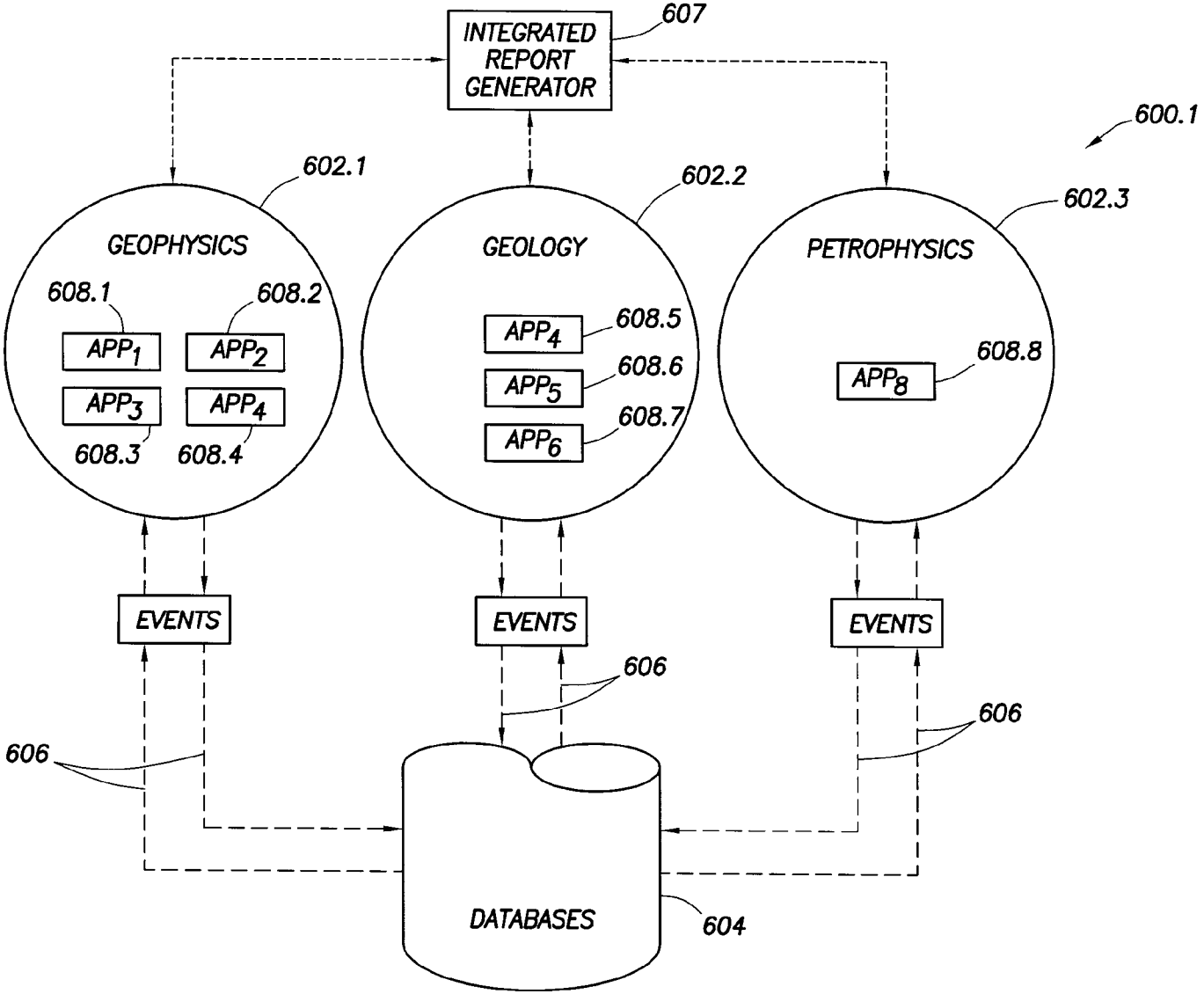
FIG.6.1

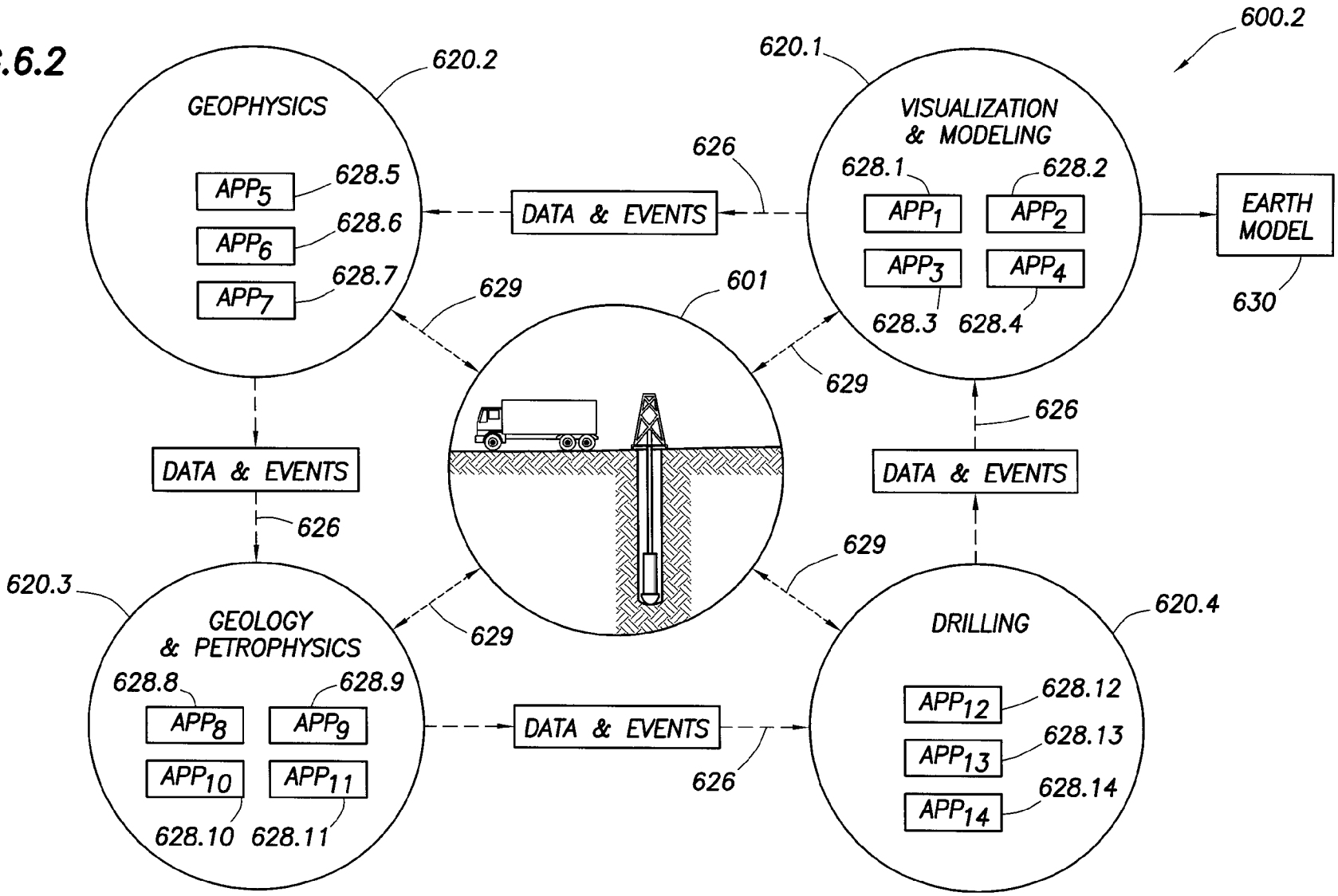
FIG. 6.2

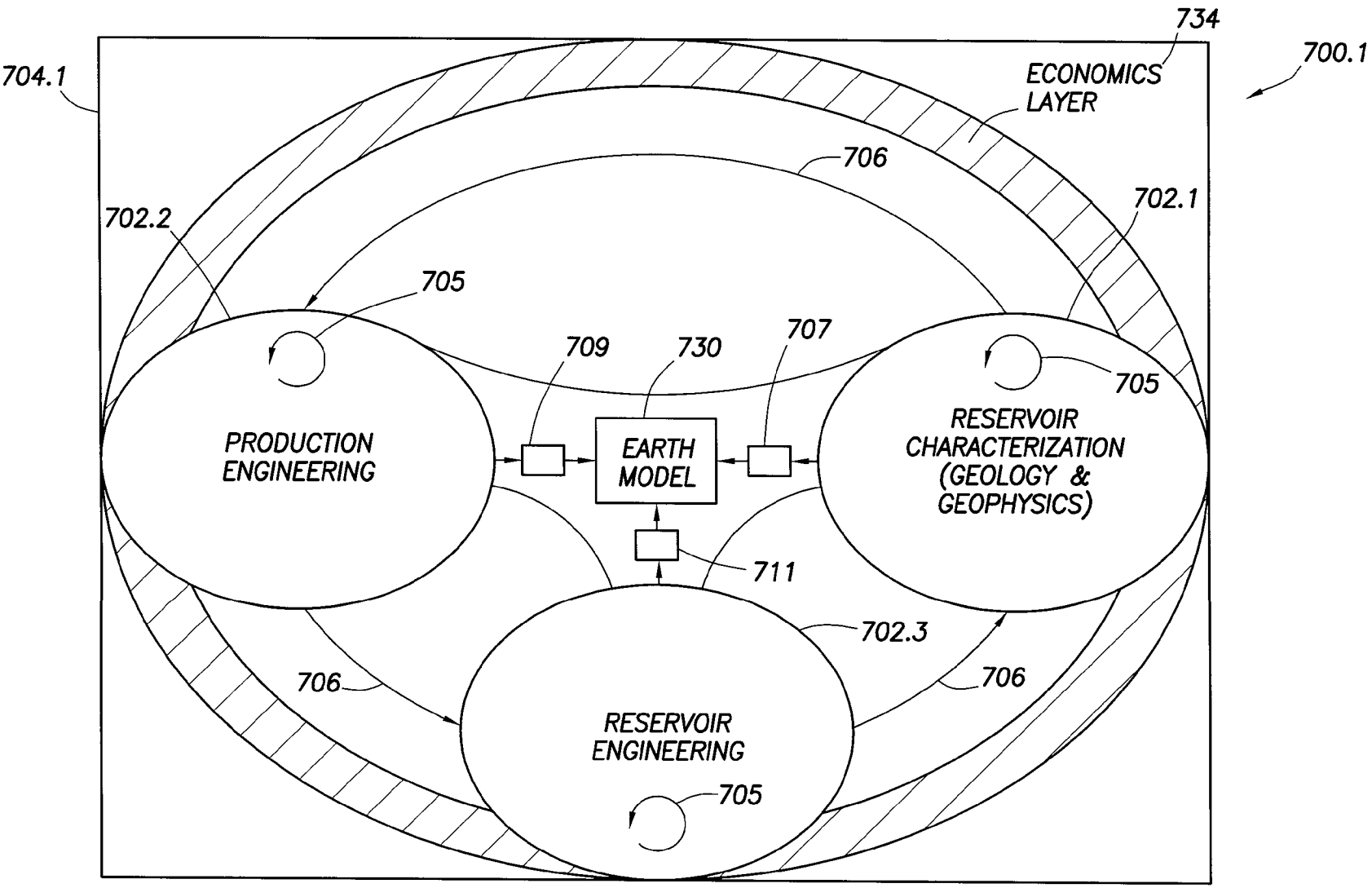
FIG. 7.1

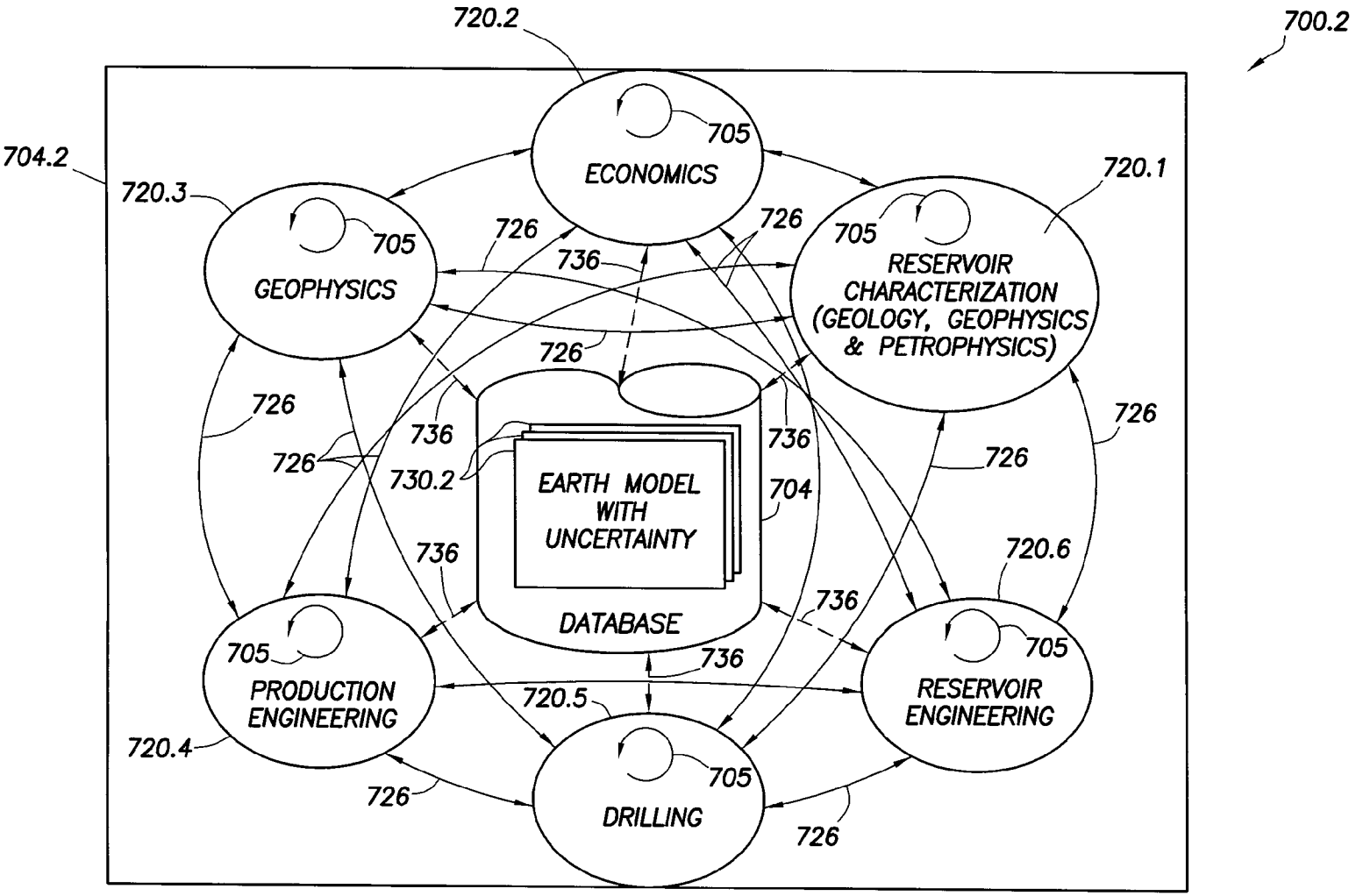
FIG. 7.2

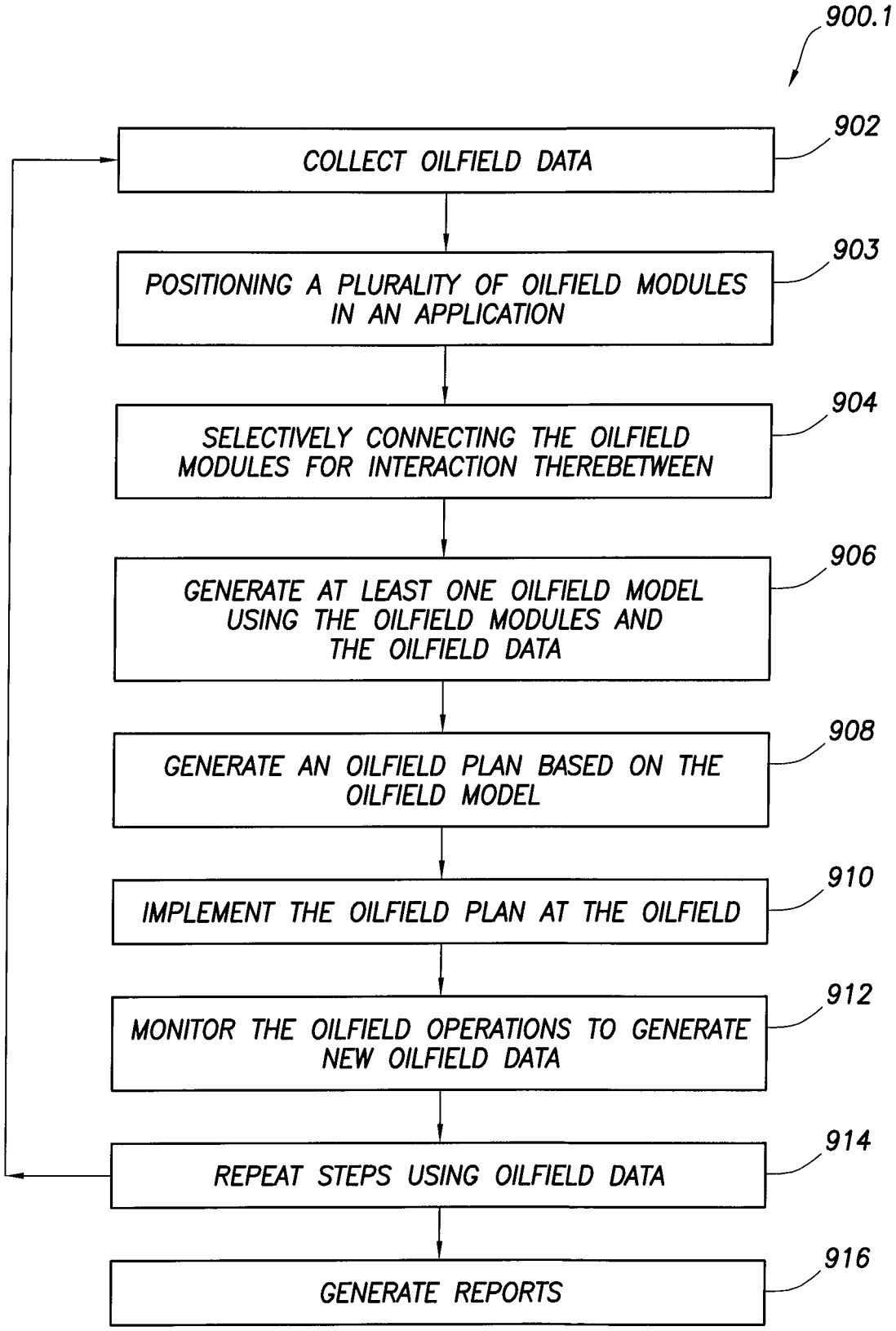
FIG.9.1

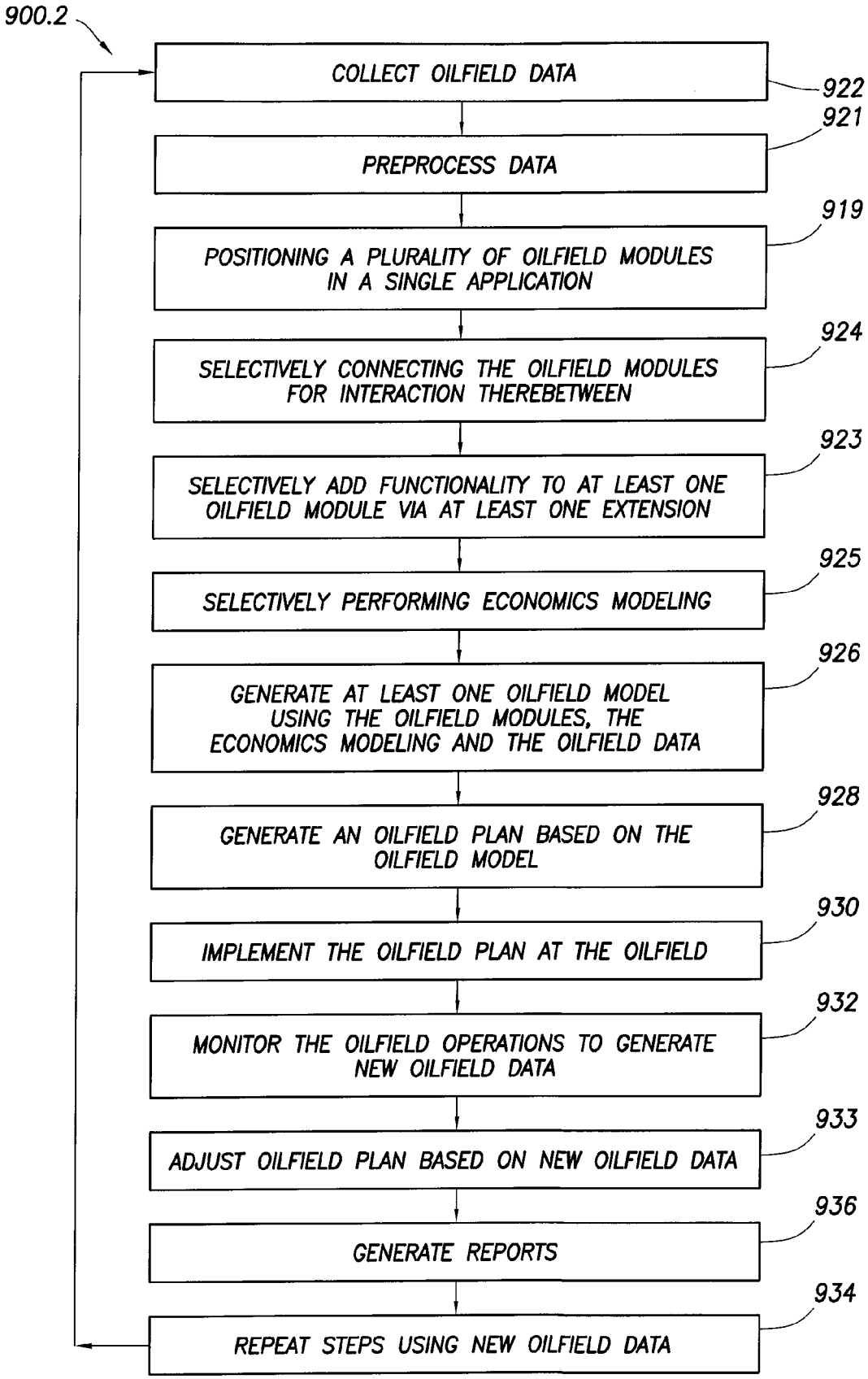
FIG.9.2

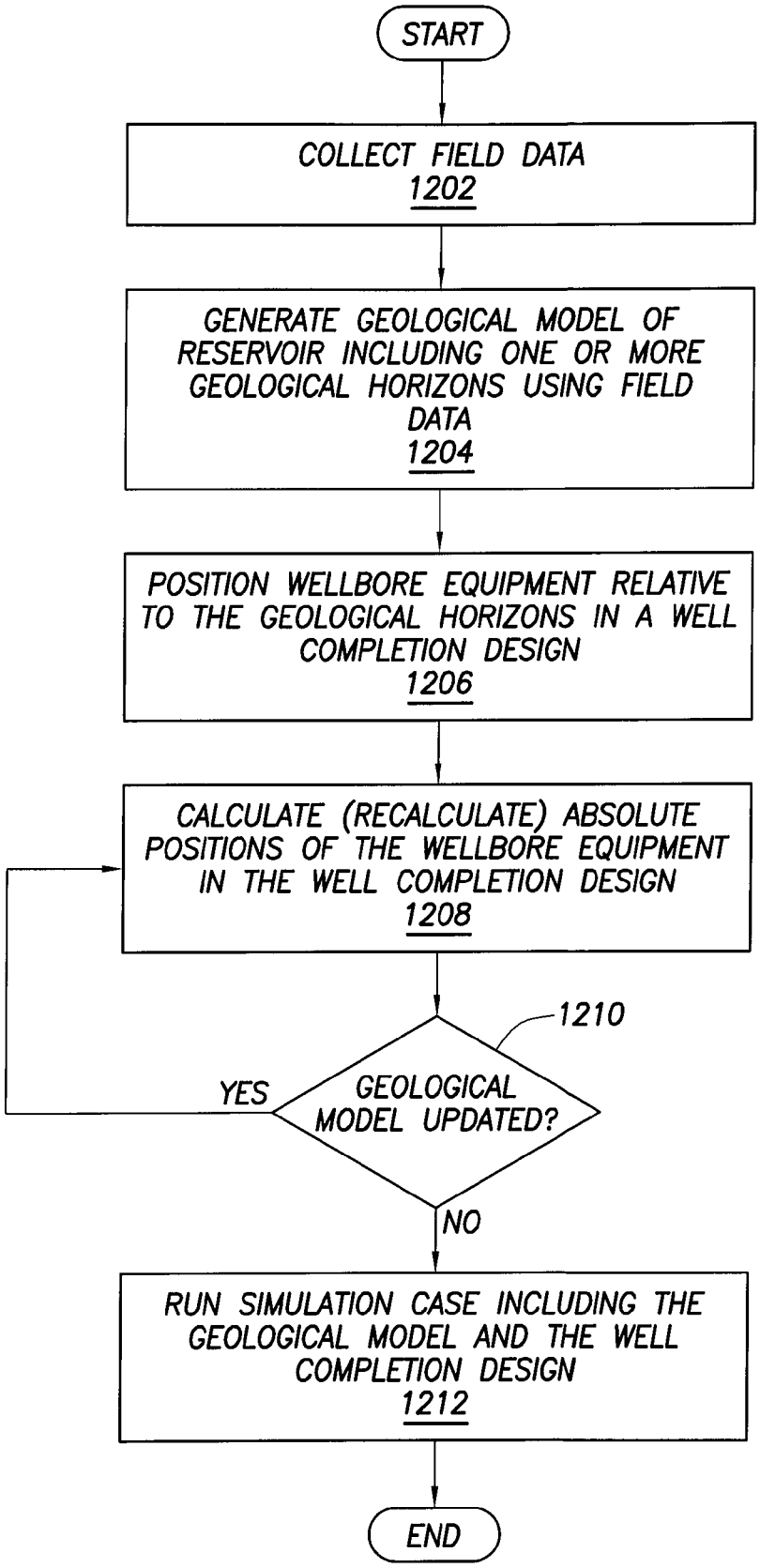
FIG. 12.1

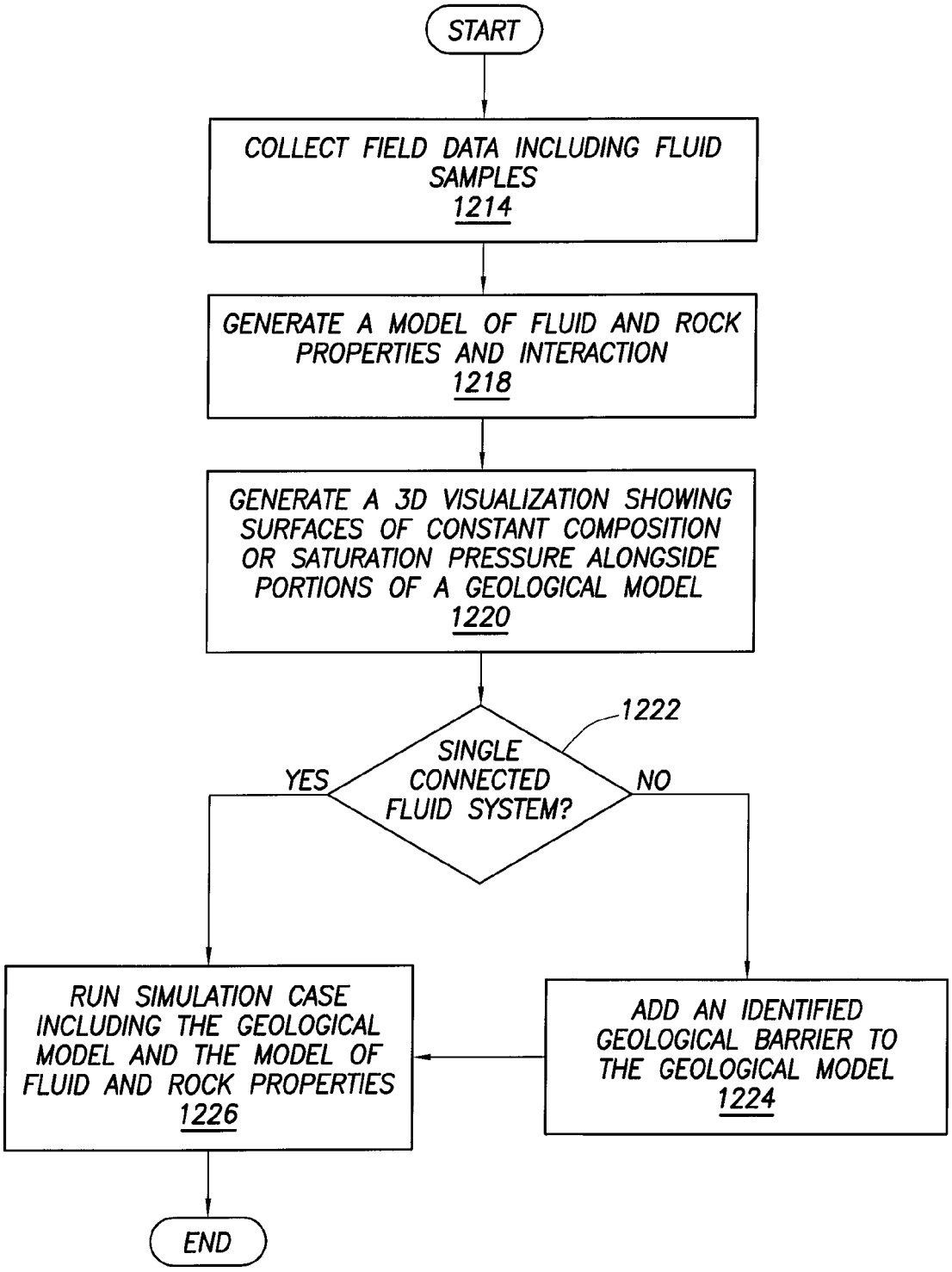
FIG. 12.2

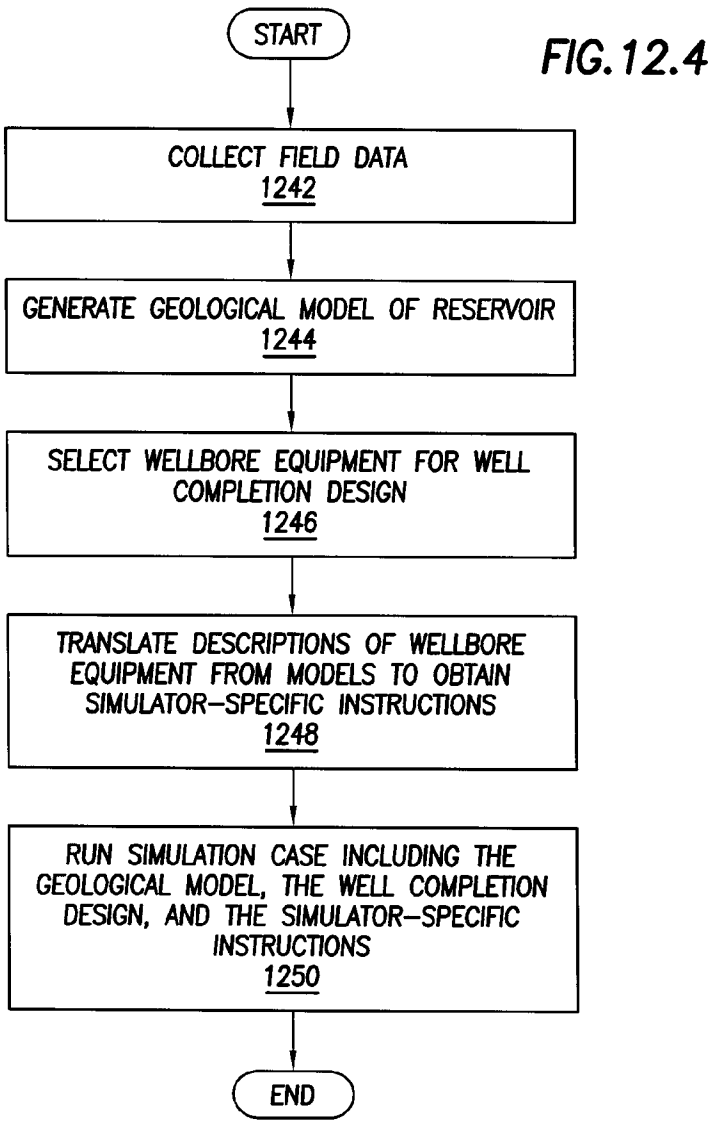
FIG. 12.4
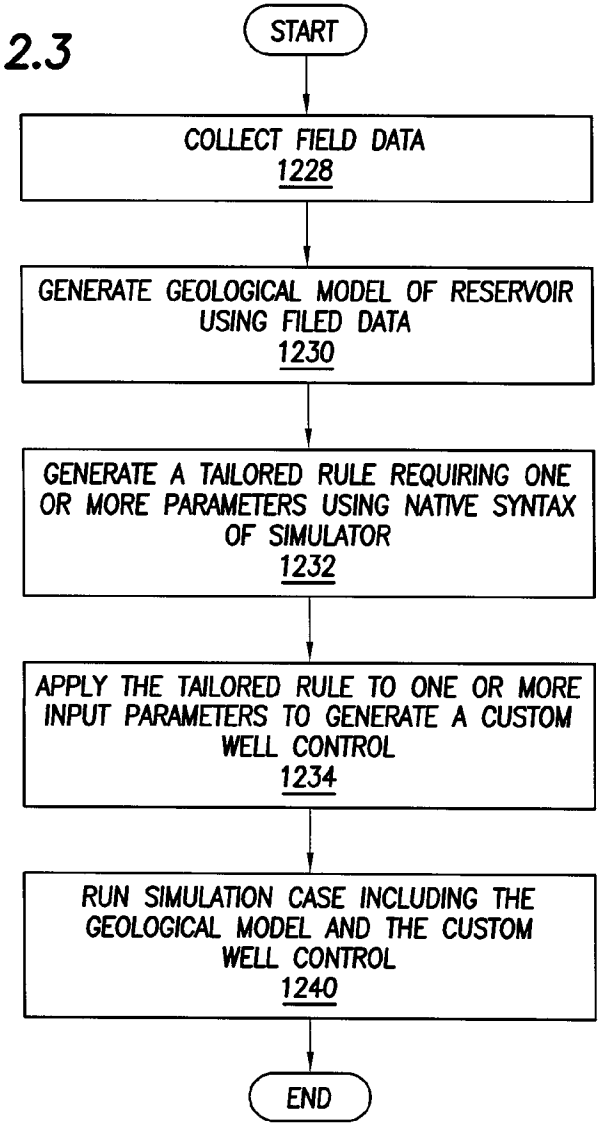
FIG. 12.3

DYNAMIC RESERVOIR ENGINEERING

CROSS-REFERENCE TO RELATED APPLICATIONS

This application claims priority, pursuant to 35 U.S.C. §119(e), to the filing date of U.S. Provisional Patent Application Ser. No. 61/021,287, entitled "System and Method for Performing Oilfield Operations," filed on Jan. 15, 2008, which is hereby incorporated by reference in its entirety.

BACKGROUND

Operations, such as surveying, drilling, wireline testing, completions, production, planning and field analysis, are typically performed to locate and gather valuable downhole fluids. Surveys are often performed using acquisition methodologies, such as seismic scanners or surveyors to generate maps of underground formations. These formations are often analyzed to determine the presence of subterranean assets, such as valuable fluids or minerals, or to determine whether the formations have characteristics suitable for storing fluids.

During the drilling, completions, production, planning and field analysis operations, data is typically collected for analysis and/or monitoring of the operations. Such data may include, for instance, information regarding subterranean formations, equipment, historical and/or other data.

Data concerning the subterranean formation is collected using a variety of sources. Such formation data may be static or dynamic. Static data relates to, for example, formation structure and geological stratigraphy that define geological structures of the subterranean formation. Dynamic data relates to, for instance, fluids flowing through the geologic structures of the subterranean formation over time. Such static and/or dynamic data may be collected to learn more about the formations and the valuable assets contained therein.

Various equipment may be positioned about the field to monitor field parameters, to manipulate the operations and/or to separate and direct fluids from the wells. Surface equipment and completion equipment may also be used to inject fluids into reservoirs, either for storage or at strategic points to enhance production of the reservoir.

SUMMARY

An example method for performing reservoir engineering includes generating a geological model of a reservoir including a geological horizon, obtaining an offset relative to the geological horizon, and positioning a wellbore equipment item in a well completion design based on the offset. The method further includes calculating an absolute position of the wellbore equipment item in the well completion design based on the offset and a location of the geological horizon in the geological model and updating the geological model to generate an updated location of the geological horizon. The method further includes updating the absolute position of the wellbore equipment item in the well completion design based on the offset and the updated location of the geological horizon and simulating a simulation case including the geological model and the well completion design after updating the absolute position of the wellbore equipment item.

Other aspects of reservoir engineering will be apparent from the following description and the appended claims.

BRIEF DESCRIPTION OF DRAWINGS

So that the above described features and advantages reservoir engineering can be understood in detail, a more particular description of reservoir engineering, briefly summarized above, may be had by reference to the embodiments thereof that are illustrated in the appended drawings. It is to be noted, however, that the appended drawings illustrate only typical embodiments of reservoir engineering and are therefore not to be considered limiting of its scope, for dynamic reservoir modeling may admit to other equally effective embodiments.

FIG. 1.1-1.4 depict a simplified, schematic view of a field having subterranean formations containing reservoirs therein, the various operations being performed on the field.

FIG. 2.1-2.4 is a graphical depiction of data collected by the tools of FIG. 1.1-1.4.

FIGS. 4.1-4.3 show schematic, 3D views of static models based on the data acquired by the data acquisition tools of FIG. 3.

FIG. 5 is graphical representation of a probability plot of the static models of FIG. 4.

FIGS. 6.1 and 6.2 are schematic diagrams depicting independent systems for generating dynamic reservoir models.

FIGS. 7.1 and 7.2 are schematic diagrams depicting integrated systems for generating dynamic reservoir models.

FIGS. 9.1 and 9.2 are flow charts depicting methods of performing oilfield operations.

FIGS. 12.1-12.4 depict flowcharts for performing reservoir engineering.

DETAILED DESCRIPTION

Figure 3:
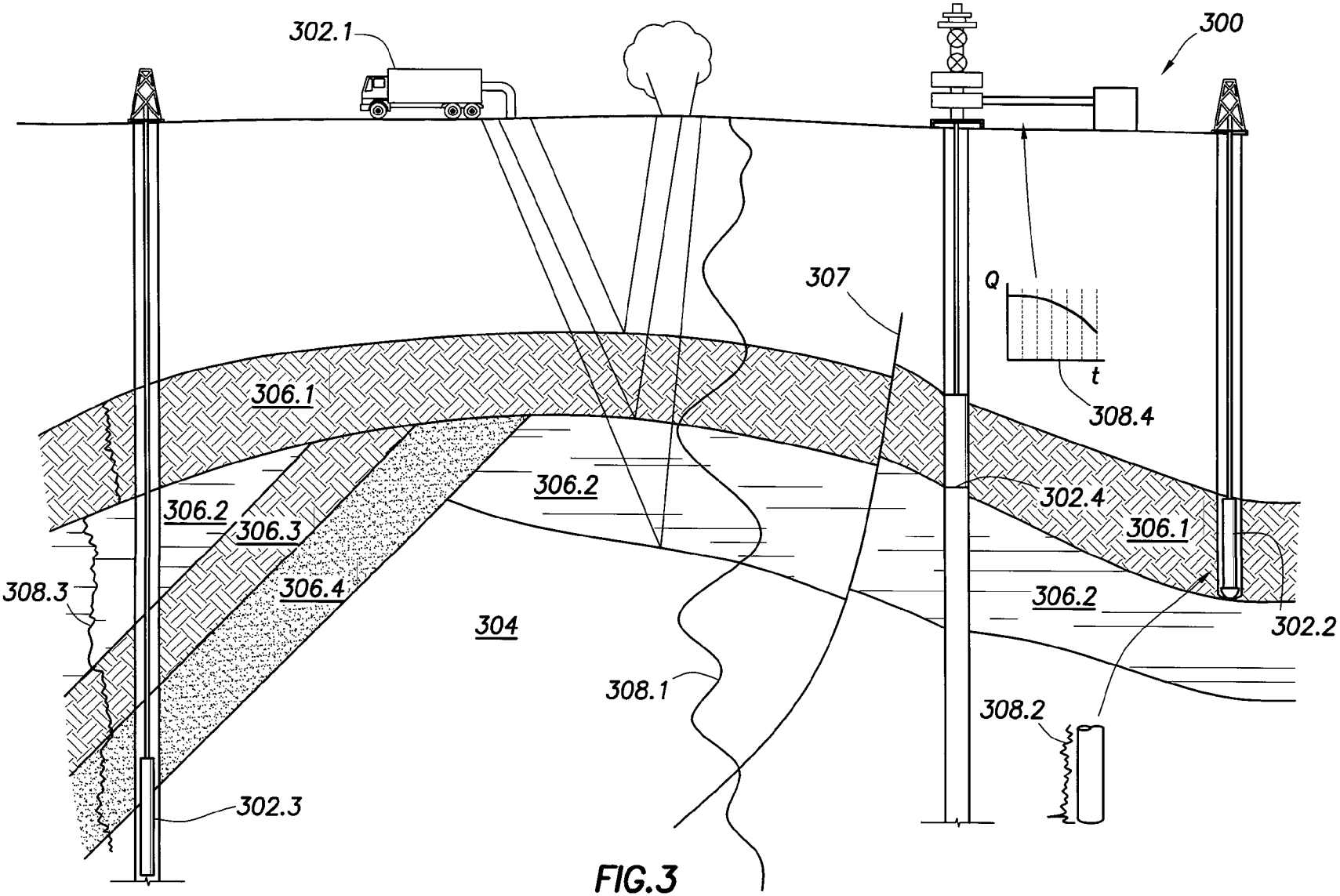
FIG. 3 is a schematic view, partially in cross section of a field having a plurality of data acquisition tools positioned at various locations along the field for collecting data from the subterranean formations.

Presently embodiments of dynamic reservoir modeling are shown in the above-identified FIGS. and described in detail below. In describing the embodiments, like or identical reference numerals are used to identify common or similar elements. The FIGS. are not necessarily to scale and certain features and certain views of the FIGS. may be shown exaggerated in scale or in schematic in the interest of clarity and conciseness.

FIGS. 1.1-1.4 depict simplified, representative, schematic views of a field 100 having subterranean formation 102 containing reservoir 104 therein and depicting various oilfield operations being performed on the field. FIG. 1.1 depicts a survey operation being performed by a survey tool, such as seismic truck 106.1, to measure properties of the subterranean formation. The survey operation is a seismic survey operation for producing sound vibrations. In FIG. 1.1, one such sound vibration 112 generated by a source 110 reflects off a plurality of horizons 114 in an earth formation 116. The sound vibration(s) 112 is (are) received in by sensors, such as geophone-receivers 118, situated on the earth's surface, and the geophones 118 produce electrical output signals, referred to as data received 120 in FIG. 1.1.

In response to the received sound vibration(s) 112 representative of different parameters (such as amplitude and/or frequency) of the sound vibration(s) 112, the geophones 118 produce electrical output signals containing data concerning the subterranean formation. The data received 120 is provided as input data to a computer 122.1 of the seismic truck 106.1, and responsive to the input data, the computer 122.1 generates a seismic data output 124. The seismic data output may be stored, transmitted or further processed as desired, for example by data reduction.

FIG. 1.2 depicts a drilling operation being performed by a drilling tool 106.2 suspended by a rig 128 and advanced into the subterranean formations 102 to form a wellbore 136. A mud pit 130 is used to draw drilling mud into the drilling tools via flow line 132 for circulating drilling mud through the drilling tools, up the wellbore 136 and back to the surface. The drilling mud is usually filtered and returned to the mud pit. A circulating system may be used for storing, controlling or filtering the flowing drilling muds. The drilling tools are advanced into the subterranean formations to reach reservoir 104. Each well may target one or more reservoirs. The drilling tools are preferably adapted for measuring downhole properties using logging while drilling tools. The logging while drilling tool may also be adapted for taking a core sample 133 as shown, or removed so that a core sample may be taken using another tool.

A surface unit 134 is used to communicate with the drilling tools and/or offsite operations. The surface unit is capable of communicating with the drilling tools to send commands to the drilling tools, and to receive data therefrom. The surface unit is preferably provided with computer facilities for receiving, storing, processing, and/or analyzing data from the oilfield. The surface unit collects data generated during the drilling operation and produces data output 135 which may be stored or transmitted. Computer facilities, such as those of the surface unit, may be positioned at various locations about the oilfield and/or at remote locations.

Sensors (S), such as gauges, may be positioned about the oilfield to collect data relating to various oilfield operations as described previously. As shown, the sensor (S) is positioned in one or more locations in the drilling tools and/or at the rig to measure drilling parameters, such as weight on bit, torque on bit, pressures, temperatures, flow rates, compositions, rotary speed and/or other parameters of the oilfield operation. Sensors (S) may also be positioned in one or more locations in the circulating system.

The data gathered by the sensors may be collected by the surface unit and/or other data collection sources for analysis or other processing. The data collected by the sensors may be used alone or in combination with other data. The data may be collected in one or more databases and/or transmitted on or offsite. All or select portions of the data may be selectively used for analyzing and/or predicting oilfield operations of the current and/or other wellbores. The data may be may be historical data, real time data or combinations thereof. The real time data may be used in real time, or stored for later use. The data may also be combined with historical data or other inputs for further analysis. The data may be stored in separate databases, or combined into a single database.

The collected data may be used to perform analysis, such as modeling operations. For example, the seismic data output may be used to perform geological, geophysical, and/or reservoir engineering. The reservoir, wellbore, surface and/or process data may be used to perform reservoir, wellbore, geological, geophysical or other simulations. The data outputs from the oilfield operation may be generated directly from the sensors, or after some preprocessing or modeling. These data outputs may act as inputs for further analysis.

The data may be collected and stored at the surface unit 134. One or more surface units may be located at the oilfield, or connected remotely thereto. The surface unit may be a single unit, or a complex network of units used to perform the necessary data management functions throughout the oilfield. The surface unit may be a manual or automatic system. The surface unit 134 may be operated and/or adjusted by a user.

The surface unit may be provided with a transceiver 137 to allow communications between the surface unit and various portions of the oilfield or other locations. The surface unit 134 may also be provided with or functionally connected to one or more controllers for actuating mechanisms at the oilfield 100. The surface unit 134 may then send command signals to the oilfield 100 in response to data received. The surface unit 134 may receive commands via the transceiver or may itself execute commands to the controller. A processor may be provided to analyze the data (locally or remotely), make the decisions and/or actuate the controller. In this manner, the oilfield may be selectively adjusted based on the data collected. This technique may be used to optimize portions of the oilfield operation, such as controlling drilling, weight on bit, pump rates or other parameters. These adjustments may be made automatically based on computer protocol, and/or manually by an operator. In some cases, well plans may be adjusted to select optimum operating conditions, or to avoid problems.

FIG. 1.3 depicts a wireline operation being performed by a wireline tool 106.3 suspended by the rig 128 and into the wellbore 136 of FIG. 1.2. The wireline tool 106.3 is preferably adapted for deployment into a wellbore 136 for generating well logs, performing downhole tests and/or collecting samples. The wireline tool 106.3 may be used to provide another method and apparatus for performing a seismic survey operation. The wireline tool 106.3 of FIG. 1.3 may, for example, have an explosive, radioactive, electrical, or acoustic energy source 144 that sends and/or receives electrical signals to the surrounding subterranean formations 102 and fluids therein.

The wireline tool 106.3 may be operatively connected to, for example, the geophones 118 and the computer 122.1 of the seismic truck 106.1 of FIG. 1.1. The wireline tool 106.3 may also provide data to the surface unit 134. The surface unit 134 collects data generated during the wireline operation and produces data output 135 which may be stored or transmitted. The wireline tool 106.3 may be positioned at various depths in the wellbore to provide a survey or other information relating to the subterranean formation.

Sensors (S), such as gauges, may be positioned about the oilfield 100 to collect data relating to various oilfield operations as described previously. As shown, the sensor (S) is positioned in the wireline tool 106.3 to measure downhole parameters which relate to, for example porosity, permeability, fluid composition and/or other parameters of the oilfield operation.

FIG. 1.4 depicts a production operation being performed by a production tool 106.4 deployed from a production unit or christmas tree 129 and into the completed wellbore 136 of FIG. 1.3 for drawing fluid from the downhole reservoirs into surface facilities 142. Fluid flows from reservoir 104 through perforations in the casing (not shown) and into the production tool 106.4 in the wellbore 136 and to the surface facilities 142 via a gathering network 146.

Sensors (S), such as gauges, may be positioned about the oilfield to collect data relating to various oilfield operations as described previously. As shown, the sensor (S) may be positioned in the production tool 106.4 or associated equipment, such as the Christmas tree 129, gathering network, surface facilities and/or the production facility, to measure fluid parameters, such as fluid composition, flow rates, pressures, temperatures, and/or other parameters of the production operation.

While only simplified wellsite configurations are shown, it will be appreciated that the oilfield 100 may cover a portion of land, sea and/or water locations that hosts one or more wellsites. Production may also include injection wells (not shown) for added recovery. One or more gathering facilities may be operatively connected to one or more of the wellsites for selectively collecting downhole fluids from the wellsite(s).

While FIGS. 1.2-1.4 depict tools used to measure properties of an oilfield, it will be appreciated that the tools may be used in connection with non-oilfield operations, such as mines, aquifers, storage or other subterranean facilities. Also, while certain data acquisition tools are depicted, it will be appreciated that various measurement tools capable of sensing parameters, such as seismic two-way travel time, density, resistivity, production rate, etc., of the subterranean formation and/or its geological formations may be used. Various sensors (S) may be located at various positions along the wellbore and/or the monitoring tools to collect and/or monitor the desired data. Other sources of data may also be provided from offsite locations.

The oilfield configuration of FIGS. 1.1-1.4 is intended to provide a brief description of an example of an oilfield usable with reservoir engineering. Part, or all, of the oilfield may be on land, water and/or sea. Also, while a single oilfield measured at a single location is depicted, reservoir engineering may be utilized with any combination of one or more oilfields, one or more processing facilities and one or more wellsites.

FIG. 2.1-2.4 are graphical depictions of examples of data collected by the tools of FIGS. 1.1-1.4, respectively. FIG. 2.1 depicts a seismic trace 202 of the subterranean formation of FIG. 1.1 taken by seismic truck 106.1. The seismic trace may be used to provide data, such as a two-way response over a period of time. FIG. 2.2 depicts a core sample 133 taken by the drilling tools 106.2. The core sample may be used to provide data, such as a graph of the density, porosity, permeability or other physical property of the core sample over the length of the core. Tests for density and viscosity may be performed on the fluids in the core at varying pressures and temperatures. FIG. 2.3 depicts a well log 204 of the subterranean formation of FIG. 1.3 taken by the wireline tool 106.3. The wireline log typically provides a resistivity or other measurement of the formation at various depts. FIG. 2.4 depicts a production decline curve or graph 206 of fluid flowing through the subterranean formation of FIG. 1.4 measured at the surface facilities 142. The production decline curve typically provides the production rate Q as a function of time t.

The respective graphs of FIGS. 2.1, 2.3, and 2.4 depict examples of static measurements that may describe or provide information about the physical characteristics of the formation and reservoirs contained therein. These measurements may be analyzed to better define the properties of the formation(s) and/or determine the accuracy of the measurements and/or for checking for errors. The plots of each of the respective measurements may be aligned and scaled for comparison and verification of the properties.

FIG. 2.4 depicts an example of a dynamic measurement of the fluid properties through the wellbore. As the fluid flows through the wellbore, measurements are taken of fluid properties, such as flow rates, pressures, composition, etc. As described below, the static and dynamic measurements may be analyzed and used to generate models of the subterranean formation to determine characteristics thereof. Similar measurements may also be used to measure changes in formation aspects over time.

FIG. 3 is a schematic view, partially in cross section of an oilfield 300 having data acquisition tools 302.1, 302.2, 302.3 and 302.4 positioned at various locations along the oilfield 300 for collecting data of the subterranean formation 304. The data acquisition tools 302.1-302.4 may be essentially the same as data acquisition tools 106.1-106.4 of FIGS. 1.1-1.4, respectively, or others not depicted. As shown, the data acquisition tools 302.1-302.4 generate data plots or measurements 308.1-308.4, respectively. These data plots are depicted along the field 300 to demonstrate the data generated by the various operations.

Data plots 308.1-308.3 are examples of static data plots that may be generated by the data acquisition tools 302.1-302.4, respectively. Static data plot 308.1 is a seismic two-way response time and may be essentially the same as the seismic trace 202 of FIG. 2.1. Static plot 308.2 is core sample data measured from a core sample of the formation 304, similar to core sample 133 of FIG. 2.2. Static data plot 308.3 is a logging trace, similar to the well log 204 of FIG. 2.3. Production decline curve or graph 308.4 is a dynamic data plot of the fluid flow rate over time, similar to the graph 206 of FIG. 2.4. Other data may also be collected, such as historical data, user inputs, economic information and/or other measurement data and other parameters of interest.

The subterranean structure 304 has a plurality of geological formations 306.1-306.4. As shown, the structure has several formations or layers, including a shale layer 306.1, a carbonate layer 306.2, a shale layer 306.3 and a sand layer 306.4. A fault 307 extends through the layers 306.1, 306.2. The static data acquisition tools are preferably adapted to take measurements and detect characteristics of the formations.

While a specific subterranean formation with specific geological structures are depicted, it will be appreciated that the oilfield may contain a variety of geological structures and/or formations, sometimes having extreme complexity. In some locations, typically below the water line, fluid may occupy pore spaces of the formations. Each of the measurement devices may be used to measure properties of the formations and/or its geological features. While each acquisition tool is shown as being in specific locations in the oilfield, it will be appreciated that one or more types of measurement may be taken at one or more location across one or more oilfields or other locations for comparison and/or analysis.

The data collected from various sources, such as the data acquisition tools of FIG. 3, may then be processed and/or evaluated. Typically, seismic data displayed in the static data plot 308.1 from the data acquisition tool 302.1 is used by a geophysicist to determine characteristics of the subterranean formations and features. Core data shown in static plot 308.2 and/or log data from the well log 308.3 are typically used by a geologist to determine various characteristics of the subterranean formation. Production data from the graph 308.4 is typically used by the reservoir engineer to determine fluid flow reservoir characteristics. The data analyzed by the geologist, geophysicist and the reservoir engineer may be analyzed using modeling techniques. Examples of modeling techniques are described in Patent/Publication/Application Nos. U.S. Pat. No. 5,992,519, WO2004/049216, WO1999/064896, U.S. Pat. No. 6,313,837, US2003/0216897, U.S. Pat. No. 7,248,259, US2005/0149307 and US2006/0197759. Systems for performing such modeling techniques are described, for example, in Patent No. U.S. Pat. No. 7,248,259, the entire contents of which is hereby incorporated by reference.

FIGS. 4.1-4.3 depict three-dimensional graphical representations of the subsurface referred to as a static model. The static model may be generated based on one or more of the models generated from, for example, the data gathered using the data acquisition tools 302.1-302.4. In the FIGS. provided, the static models 402.1-402.3 are generated by the data acquisition tools 302.1-302.3 of FIG. 3, respectively. These static models may provide a bi-dimensional view of the subterranean formation, based on the data collected at the given location.

The static models may have different accuracies based on the types of measurements available, quality of data, location and other factors. While the static models of FIGS. 4.1-4.3 are taken using certain data acquisition tools at a single location of the oilfield, one or more of essentially the same or different data acquisition tools may be used to take measurements at one or more locations throughout the oilfield to generate a variety of models. Various analysis and modeling techniques may be selected depending on the desired data type and/or location.

Each of the static models 402.1-402.3 is depicted as volumetric representations of an oilfield with one or more reservoirs, and their surrounding formation structures. These volumetric representations are a prediction of the geological structure of the subterranean formation at the specified location based upon available measurements. Preferably, the representations are probable scenarios, created using the same input data (historical and/or real time), but having differing interpretation, interpolation, and modeling techniques. As shown, the static models contain geological layers within the subterranean formation. In particular fault 307 of FIG. 3 extends through each of the models. Each static model also has reference points A, B and C located at specific positions along each of the static models. These static models and the specific reference points of the static models may be analyzed. For example, a comparison of the different static models may show differences in the structure of fault 307 and the adjacent layer 306.1. Each of the reference points may assist in the comparison between the various static models. Adjustments may be made to the models based on an analysis of the various static models in FIGS. 4.1-4.3, and an adjusted formation layer may be generated as will be described further below.

FIG. 5 is graphical representation of a probability plot of multiple static models, such as the models (402.1-402.3) of FIGS. 4.1-4.3. The graph depicts a range of reservoir attribute value (V), such as volumetrics, production rate, gross rock thickness, net pay, cumulative production, etc. The value of the reservoir attribute (V) can vary due to any static or dynamic component(s) being assessed, such as structure, porosity, permeability, fluid contact levels, etc. The variables are typically constrained in the modeling exercise to be within reasonable predictions of what the real reservoir(s) are capable of, or what has been observed in similar reservoirs. This graph is a histogram depicting multiple model realizations that may be generated by the provided data. The variable results may be generated by varying multiple model parameters. The graph may then be generated by reviewing and estimating the probability of the models generated and plotting them.

As depicted, all the model realizations that make up the distribution graph are equally probable in geological terms. The histogram indicates that static model (402.1) provides a ninety percent probability of having at least that amount of variable (V). The histogram as depicted also indicates that static model (402.2) has a fifty percent probability of having at least that amount of variable (V), and static model (402.3) a ten percent probability of having this higher amount This graph suggests that static model (402.3) is the more optimistic model estimate of variable (V). The static models and their associated likelihoods may be used, for example in determining field development plans and surface facility production model. A static model representation (402.1) through (402.3) may be selected based upon a desired risk and/or economic tolerance.

Referring back to the static models of FIGS. 4.1-4.3, the models have been adjusted based on the dynamic data provided in the production of the graph 308.4 of FIG. 3. The dynamic data collected by data acquisition tool 302.4 is applied to each of the static models 4.1-4.3. As shown, the dynamic data indicates that the fault 307 and layer 306.1 as predicted by the static models may need adjustment. The layer 306.1 has been adjusted in each model as shown by the dotted lines. The modified layer is depicted as 306.1', 306.1" and 306.1''' for the static models of FIGS. 4.1-4.3, respectively.

The dynamic data may indicate that certain static models provide a better representation of the oilfield. A static model's ability to match historical production rate data may be considered a good indication that it may also give accurate predictions of future production. In such cases, a preferred static model may be selected. In this case, while the static model of FIG. 4.3 may have the highest overall probability of accuracy based solely on the static model as shown in FIG. 5, an analysis of the dynamic model suggests that the model of FIG. 4.2 is a better match. As shown in FIGS. 4.1-4.3, a comparison of layers 306.1 with layers 306.1', 306.1" and 306.1''' indicates that fault 307 with associated fluid transmissibility across the fault most closely matches the prediction provided by static model 402.2.

In this example, the selected static model 402.2 is modified based on the dynamic data. The resulting adjusted model 402.2 has been adjusted to better match the production data. As shown, the position of the geological structure 306.1 has been shifted to 306.1" to account for the differences shown by the dynamic data. As a result, the static model may be adapted to better fit both static and dynamic models.

In determining the best overall earth model, the static and/or dynamic data may be considered. In this case, when considering both the static and dynamic data, the static model 402.2 of FIG. 4.2 is selected as the earth model with the highest probability of accuracy based on both the static probabilities and dynamic input. To obtain the best overall model, it may be desirable to consider the static and dynamic data from multiple sources, locations and/or types of data.

The evaluation of the various static and dynamic data of FIG. 3 involves considerations of static data, such as seismic data considered by a geophysicist (308.1), geological data considered by a geologist 308.2, 308.3 and production data considered by a reservoir engineer 308.4. Each individual typically considers data relating to a specific function and provides models based on this specific function. However, as depicted in FIGS. 4.1-4.3, information from each of the separate models may affect the decision on the best overall earth model. Moreover, information from other models or sources may also affect adjustments to the model and/or selection of the best overall earth model. The earth model generated as described in FIGS. 4.1-4.3 is a basic earth model determined from an analysis of the various models provided.

Another source of information that may affect the model(s) is economic information. Throughout the oilfield operations depicted in FIGS. 1.1-1.4, there are numerous business considerations. For example, the equipment used in each of FIGS. 1.1-1.4 has various costs and/or risks associated therewith. At least some of the data collected at the oilfield relates to business considerations, such as value and risk. This business data may include, for example, production costs, rig time, storage fees, price of oil/gas, weather considerations, political stability, tax rates, equipment availability, geological environment, accuracy and sensitivity of the measurement tools, data representations and other factors that affect the cost of performing the oilfield operations or potential liabilities relating thereto. Decisions may be made and strategic business plans developed to alleviate potential costs and risks. For example, an oilfield plan may be based on these business considerations. Such an oilfield plan may, for example, determine the location of the rig, as well as the depth, number of wells, duration of operation, rate of production, type of equipment, and other factors that will affect the costs and risks associated with the oilfield operation.

FIGS. 6.1, 6.2, 7.1, 7.2, and 8 depict various systems for performing oilfield operations for an oilfield. These various systems describe various configurations that may be used to perform the oilfield operations. In each system, various modules are operatively connected to perform the desired operation(s).

FIGS. 6.1 and 6.2 are schematic diagrams depicting independent systems for performing an oilfield operation. As will be described below, the independent system has individual modules containing separate applications that are operatively connected to perform various modeling operations for an oilfield. FIG. 6.1 depicts an independent database system 600.1 having separate applications and a common database. The database system includes oilfield modules 602.1-602.3 and shared database 604 with database connections 606 therebetween. The database system is also provided with an integrated report generator 607.

The oilfield modules as shown include geophysics module 602a having applications 608.1-608.4 separately positioned therein, geology module 602.2 having applications 608.5-608.7 separately positioned therein and petrophysics module 602.3 having application 608.8 therein. Database connections 606 are positioned between each oilfield module and the shared database for passing events therebetween as depicted by the dashed arrows 606.

In this configuration, the individual modules may perform a modeling operation as previously described for the specific functions using separate applications to process the information. In this example, each module performs its modeling using separate applications and passes its events to the shared database. As used herein, an event is an activity marker indicating that something has happened, such as a user input (e.g. mouse click), a changed data value, a completed processing step, or a change in the information stored in the database (e.g., adding new measurements, performing a new analysis, or updating a model). Each module may access any event from the database and use such events as inputs into its separate modeling operation.

The geophysics module 602.1 performs individual geophysical analysis of the oilfield. For example, the module may perform synthetic modeling of the seismic response based on the information generated from the log data collected from the logging tool 106.2 of FIG. 1.2.

The geology module 602.2 performs individual geological analysis of the oilfield. For example, the module may perform modeling of the geological formations of the oilfield based on the information generated from the log data collected from the logging tool 106.2 of FIG. 1.2.

The petrophysics module 602.3 performs individual petrophysical analysis of the oilfield. For example, the module may perform modeling of the rock and fluid responses based on the information generated from the log data collected from the logging tool 106.2 of FIG. 1.2.

Database connections 606 are depicted as dashed arrows positioned between the modules and databases. The database connections 606 enable the passage of events between each of the separate modules and the database. The separate modules may send and receive events from the shared database as indicated by the arrows. While the database connections are depicted as passing data from the database to a selected module, or vice versa, various connections may be positioned in the system to provide the passage of events between one or more databases, reports, modules or other components of the independent database system.

The integrated report generator 607 is used to provide information from the modules. The reports may be sent directly to the oilfield, offsite locations, clients, government agencies and/or others. The reports may be independently generated by any one or more of the modules or applications, or integrated for consolidated results prior to distribution. The format of the reports may be user defined and provided in any desired media, such as electronic, paper, displays or others. The reports may be used as input to another sources, such as spreadsheets. The reports may be analyzed, re-formatted, distributed, stored, displayed or otherwise manipulated as desired.

Preferably, the report generator may be capable of storing all aspects of the oilfield operation and/or the processing of information for the independent database system. The integrated report generator may automatically obtain information from the various modules and provide integrated reports of the combined information. The integrated report generator can also provide information about the modeling processes and how results were generated, for example in the form of a Sarbanes-Oxley audit trail. Preferably, the reports may be tailored to provide the desired output in the desired format. In some cases, such reports may be formatted to meet government or other third party requirements.

The database 604 houses data from the oilfield, as well as interpretation results and other information obtained from the module(s) 602.1-602.3. As used herein the term database refers to a storage facility or store for collecting data of any type, such as relational, flat or other. The database can be located remotely, locally or as desired. One or more individual databases may be used. While only one database is depicted, external and/or internal databases may be provided as desired. Security measures, such as firewalls, may be provided to selectively restrict access to certain data.

FIG. 6.2 depicts an independent process system 600.2. This process system has separate applications, and is in communication with an oilfield. The process system includes oilfield modules 620.1-620.4 with process connections 626 therebetween for generating a combined earth model. In this case, the combined earth model may be essentially the same as the basic earth model of FIGS. 4.1-4.3, except that the combined earth model is created using multiple modules connected via process connections to generate an earth model.

The oilfield modules as shown include a visualization & modeling module 620.1 having applications 628.1-628.4 separately positioned therein, a geophysics module 620.2 having applications 628.5-628.7 separately positioned therein, geology & petrophysics module 620.3 having applications 628.8-628.11 separately positioned therein and drilling module 620.4 having applications 628.12-628.14 separately positioned therein. Process connections 626 are positioned between each oilfield modules for passing data and events therebetween as depicted by the dashed arrows.

The geophysics module 620.2 may be essentially the same as the geophysics module 602.1 of FIG. 6.1. The geology & petrophysics module 620.3 may perform essentially the same functions as the geology module 602.2 and petrophysics module 602.3 of FIG. 6.1, except the functions are merged into a single module. This demonstrates that various modules may be merged into a single module for combined functionality. This FIG. also depicts the ability to have modules defined with the desired functionality. One or more functions can be provided for the desired modules.

The drilling module 620.4 performs modeling of a drilling operation of the oilfield. For example, the module may model drilling responses based on the information generated, for example from the drilling data collected from the logging tool of FIG. 1.2.

The visualization & modeling module 620.1 generates a combined earth model 630 based on the information collected from the other modules 620.2-620.4. The combined earth model is similar to the basic earth model previously described with respect to FIGS. 4.1-4.3, except that it provides an overall view of the oilfield operation based on a combined analysis provided by the various modules as depicted. This module may also be used to generate graphics, provide volumetrics, perform uncertainty assessments or other functions.

As shown, the independent process system enables each individual module to perform its individual modeling function and pass data and events generated therefrom to the next module. In this manner, modeling is performed by the separate applications in the visualization & modeling module, and data and events are passed to the geophysics module. The geophysics module performs its separate modeling using its separate applications, and passes data and events to the geology & petrophysics module. The geology and petrophysics module performs its modeling using its separate applications, and passes its data and events to the drilling module. The drilling module 620.4 performs modeling of the drilling operation, and passes its data and events to the visualization & modeling module. The visualization and modeling module is then used to generate a combined earth model 630.

The process connections 626 are similar to the database connections 606 of FIG. 6.1. In this case, the process connections provide a means for passing both data and events to the next module for use as an input to the next module in the modeling process. As depicted, the data flows in one direction through the independent process system. As will be described in greater detail below, the connections may be reconfigured to permit flow in multiple directions between desired modules.

As shown, the independent process system of FIG. 6.2 may be operatively connected via an oilfield connection 629 to an oilfield via oilfield inputs/outputs 601 for operation therewith. The oilfield may be essentially the same as the oilfield 100 (FIGS. 1.1-1.4) or 300 (FIG. 3) previously described. Data from the oilfield may be transferred via the oilfield inputs/outputs directly input into one or more of the modules. The results generated from the process system may be returned to the oilfield via the oilfield inputs/outputs for responsive action. A surface unit of the oilfield may receive the results and process the information. This information may be used to activate controls or send commands to equipment at the oilfield. Controls may be provided to actively adjust the oilfield operation in response to the commands. Automatic and/or manual controls may be activated based on the results. The results may be used to provide information to and/or real-time operation at the oilfield. The data may also be applied to other oilfields for historical or comparative value.

FIGS. 7.1 and 7.2 are schematic diagrams depicting integrated systems for performing an oilfield operation. As will be described below, the integrated system has modules positioned within a single application to perform various modeling operations for an oilfield. FIG. 7.1 depicts a unidirectional integrated system 700.1 for performing oilfield operations. The uni-directional integrated system has a plurality of oilfield modules 702.1-702.3 positioned in the same application 704.1 with an economics layer 734 positioned about the modules. In this case, the modules are within a single application and, therefore, share data and events to generate an oilfield model, such as shared earth model 730.1. The shared earth model of FIG. 7.1 may be essentially the same as the basic earth model of FIGS. 4.1-4.3 or the combined earth model of FIG. 6.2, except that the model is created by modules connected via uni-directional module connections in a single application.

As depicted in FIG. 7.1, each module is operatively connected within the application via uni-directional model connections 706 to perform modeling according to a one-way sequence in the system. In other words, the reservoir characterization module performs its modeling, then the production engineering performs its modeling and finally the reservoir engineering module performs its modeling to generate a shared earth model. The uni-directional model connections are depicted as arrows denoting the one-way flow of the modeling process as the operation is being performed by the various modules.

The unidirectional integrated system 700.1 permits the modules to sit within one application so that data and events may be shared without the requirement of a connection for passage therebetween as shown, e.g., by connections 606 of FIG. 6.1 or 626 of FIG. 6.2. The modules are positioned in the same space and have the ability to view the operation of the other modules on the shared earth model. In this configuration, the various modules can participate in the modeling operation of the entire system thereby permitting an integrated view and integrated operation of the modeling process.

The reservoir characterization module 702.1 as depicted performs both geology and geophysics functions, such as those used by as modules 602.1 and 602.2 (depicted FIG. 6.1) previously described. As shown here, the functionality of multiple modules may be merged into a single module for performing the desired functions. The merging of functionalities in a single module may enable additional and/or synergistic functionality. As shown here, the reservoir characterization module is capable of performing geostatistic and other property distribution techniques. The reservoir characterization module having multiple functionality permits multiple workflows to be performed in a single module. Similar capabilities may be generated by merging other modules, such as the geology and petrophysics module 620.3 depicted in FIG. 6.2. The reservoir characterization module performs its modeling operation and generates a static earth model 707.

The circular arrow 705 depicts the ability of the reservoir characterization module to perform iterations of the workflows to generate a converged solution. Each module is provided with convergence capabilities so that they may repeat the modeling process as desired until a certain criteria, such as time, quality, output or other requirement, is met.

Once the reservoir characterization has performed its modeling operation, the process may be advanced as depicted by curved arrow 706 so that the production engineering module may perform its modeling operation. The production engineering module 702.2 is similar to the modules previously described except that it is used to perform production data analysis and/or modeling, for example using the production data collected from the production tool 106.4 depicted in FIG. 1.4. This involves an analysis of the production operation from removal of fluids from the reservoir, to transport, to surface facilities as defined by the user. The circular arrow 705 depicts the ability of the production module to perform iterations of the workflows to generate a converged solution as previously described. The production module performs its modeling operation and generates a production historical analysis 709.

Once the production engineering module has performed its modeling operation, the process may be advanced as depicted by curved arrow 706 so that the reservoir engineering module may perform its modeling operation. The reservoir engineering module 702.3 is similar to the modules previously described except that it is used to perform reservoir engineering/dynamic data analysis and/or modeling. This involves an analysis of the subterranean reservoir, for example using the production data collected from the production tool 106.4 depicted in FIG. 1.4. The circular arrow 705 depicts the ability of the reservoir module to perform iterations of the workflows to generate a converged solution as previously described. The resulting solution may then be passed to the reservoir characterization module as depicted by curved arrow 706. The reservoir engineering module generates a dynamic (or predictive) earth model 711.

As indicated by the curved arrows 706, the process may be continuously repeated as desired. The static earth model 707, the production historical analysis 709 and the dynamic model 711 are combined to generate a shared earth model 730.1. This shared earth model may be refined over time as new data is passed through the system, as new workflows are implemented in the analysis and/or as new interpretation hypotheses are input into the system. The process may be repeated and the outputs of each module refined as desired.

The system is also provided with economics layer 734 for providing economics information concerning the oilfield operation. The economics layer provides capabilities for performing economics analysis and/or modeling based on inputs provided by the system. The modules may provide data to and/or receive data from the economics layer. As depicted, the economics layer is positioned in a ring about the system. This configuration demonstrates that the economics may be performed at any time or during any process throughout the system. The economics information may be input at any time and queried by any of the modules. The economics module provides an economic analysis of any of the other workflows throughout the system.

With the layer configuration, economics constraints may provide a pervasive criterion that propagates throughout the system. Preferably, this configuration allows the criteria to be established without the requirement of passing data and events to individual modules. The economics layer may provide information helpful in determining the desired shared earth model and may be considered as desired. If desired, warnings, alerts or constraints may be placed on the shared earth model and/or underlying processes to enable adjustment of the processes.

FIG. 7.2 depicts a bi-directional integrated system 700.2. In this configuration, the modules are provided with an internal database and generate an integrated earth model. The bi-directional integrated system 700.2 has a plurality of oilfield modules 720.1-720.6 positioned in the same application 704.2. These modules include reservoir characterization module 720.1, an economic module 720.2, a geophysics module 720.3, a production engineering module 720.4, a drilling module 720.5, and a reservoir engineering module 720.6. In this case, the modules are connected by bi-directional curved arrows 726. As depicted the modules are provided with convergence capabilities as depicted by circular arrow 705. One or more of the modules may be provided with such convergence capabilities as previously described with respect to FIG. 7.1.

The modules 720.1-720.6 may be essentially the same as the modules previously described, except that they are provided with the functionality as desired. For example, geophysics module 720.3, production engineering module 720.4, reservoir engineering module 720.6 and drilling module 720.5 may be essentially the same as modules 620.2, 702.2, 702.3 and 620.4 respectively.

Reservoir characterization module 720.1 may be essentially the same as reservoir characterization module 702.1, except this version is further provided with petrophysics capabilities. As shown, the reservoir characterization module contains geology, geophysics and petrophysics capabilities. The geologist along with the geophysicist and the petrophysicist may make multiple static model realizations in one module based upon available seismic and well measurements, referenced to known model analogues for the region. Such known data typically has high accuracy at the wells and less reliable location positioning for the seismic data. Physical rock and fluid properties can typically be accurately measured at the well locations, while the seismic can typically be used to grossly represent the changing reservoir formation characteristics between the well locations. Various data interpretation methodologies and model property distribution techniques may be applied to give as accurate a representation as possible. However, there may be numerous methods for interpretation and model creation that directly affect the model's real representation of the reservoir. A given methodology may not always be more accurate than another.

In this version, economics is provided via economics module 720.2, rather that a layer 734 as depicted in FIG. 7.1. The economics module in this case demonstrates that the economics functionality may be provided in a module form and connected with other modules.

As with the case depicted in FIG. 7.1, the models are positioned within a single application and, therefore, share data and events to generate an integrated earth model 730.2. In this case, a plurality of integrated earth models 730.2 are generated by each module in a bi-directional sequence through the system. In other words, the selected module(s) (e.g. reservoir characterization, economics, geophysics, production engineering, drilling and/or reservoir engineering) may each perform their modeling in sequence to generate an integrated earth model. The process may be repeated to generate additional integrated earth models. As depicted by the bidirectional arrows 726, the process may be reversed, repeated and performed in any order throughout the bi-directional integrated system.

The modules of FIG. 7.2 are operatively connected via bi-directional module connections as depicted by curved arrows 726 to each of the other modules. This configuration demonstrates that certain modules may be selectively connected to perform the desired modeling operations in the desired sequence. In this manner, a selected module may directly interact with any other selected module(s) as desired. While multiple connections are depicted as providing a connection with each other module, a variety of configurations may be used to establish the connected network as desired. This provides a flexible connecting system for selectively defining the modules to perform the desired modeling operation.

The integrated earth model 730.2 is created from contributions from the selected modules. As described previously, the reservoir characterization module may be used to generate a static model, the production engineering module may be used to generate historical information, and the reservoir engineer may be used to generate the dynamic model. The geophysics module may be used to generate the basic configuration of the model. The economics module may be used to define the business or economic viability of the integrated earth model. The drilling module may be used to determine the optimized position of new drilling locations or re-completions of existing wells. Other modules may be added to the system with additional connections to provide data and events accessible by other modules and/or to contribute to creating the overall integrated earth model.

The integrated earth model is generated by selectively combining the contributions from the selected modules. The flexibility of the system permits the user to pre-define, adjust and/or otherwise manipulate the configuration of the modeling process as well as the resulting integrated earth models. The system permits the creation of multiple integrated earth models based on uncertainties inherent to the system. The uncertainties may be, for example, inaccuracies in the raw data, the assumptions of the algorithms, the ability of the models to accurately represent the integrated earth model and others. The system may be operated using multiple variables and/or scenarios to generate multiple integrated earth models. The output of multiple integrated earth models based on various methods used to perform multiple versions of the modeling process is often referred as multiple realizations. The generated integrated earth model is, therefore, said to be provided with uncertainties.

The system is provided with a database 704. As shown, the database is positioned within the application for access by each of the modules. A database connection 736 is provided for the passage of data and/or events therebetween. The database may be essentially the same as database 604 depicted in FIG. 6.1. In addition to the raw data and interpretation results housed in database 604, the database 704 may also be provided with a record of the process which generated the end results, the interdependencies between the modules that were used during the analysis, user information (e.g. data quality tags, comments, etc.) as well as any other desired information or processes. This provides the ability to record how an integrated earth model was generated, and to keep a record of other input relating to the process. This also permits the selective storage, replay and/or reuse of various portions of the process used by the system, knowledge capture and scenario planning and testing.

Figure 8:
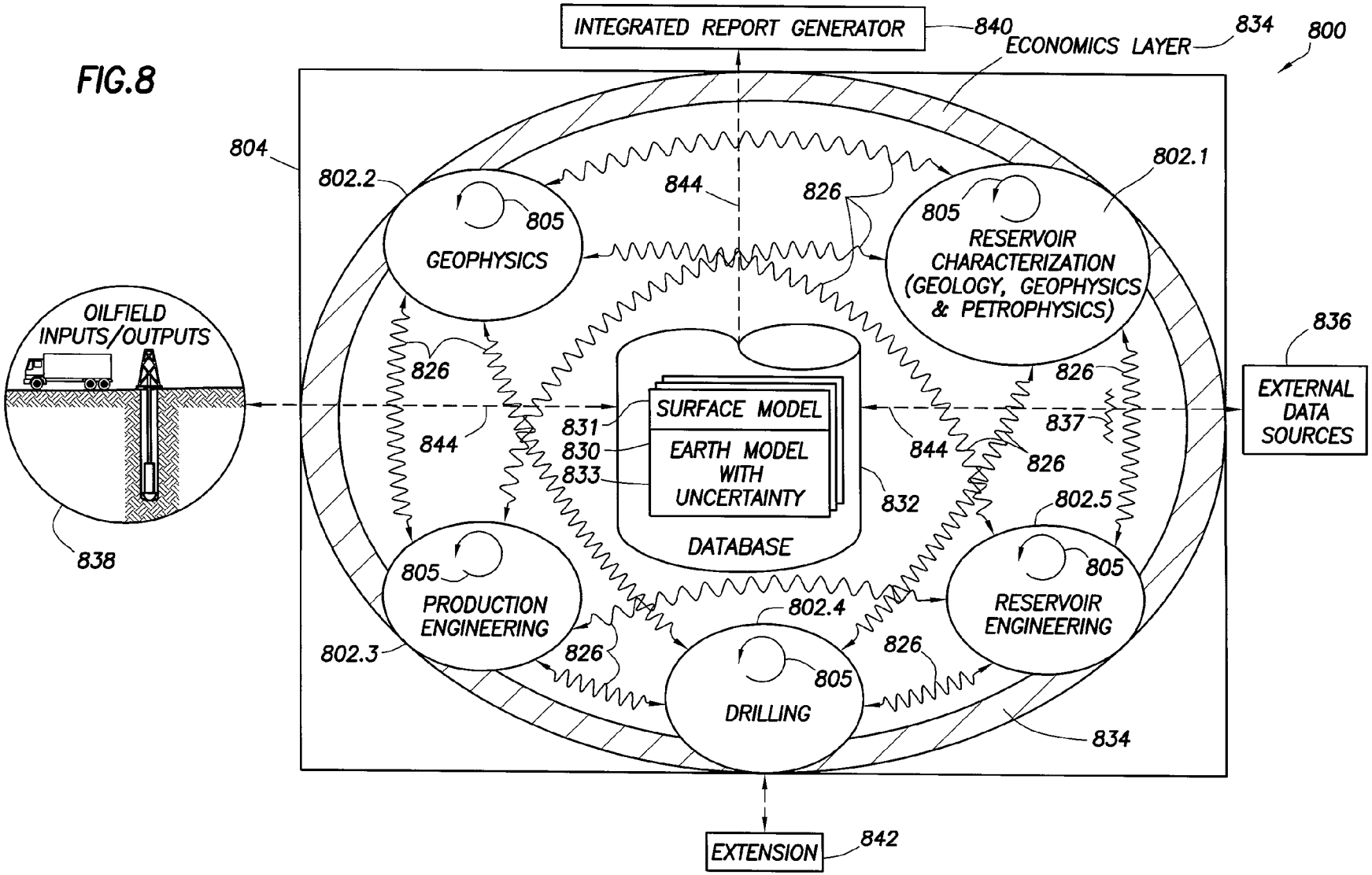
FIG. 8 depicts a unified system for generating dynamic reservoir models.

FIG. 8 depicts a unified system 800 for performing an oilfield operation. As will be described below, the unified system has modules positioned within an application and dynamically connected to perform the oilfield operations. FIG. 8 provides a unified system of modules connected by dynamic connections and having functionality similar to the reports 607 depicted in FIG. 6.1, the real-time functionality depicted in FIG. 6.2, the economics layer 734 depicted in FIG. 7.1 and the database 704 depicted in FIG. 7.2.

The unified system has a plurality of oilfield modules 802.1-802.5, an internal database 832, an economics layer 834, external data source 836, oilfield inputs/outputs 838 and integrated report generator 840. The modules 802.1-802.5 may be essentially the same as the modules previously described, except that they are provided with additional functionally as desired. For example, reservoir engineering module 802.1, geophysics module 802.2, production engineering module 802.3, drilling module 802.4 and reservoir engineering module 802.5 may be essentially the same as modules 720.1, 720.3, 720.4, 720.5 and 720.6, respectively, of FIG. 7.2. These modules may optionally be provided with convergence capabilities 805 similar to those depicted in FIG. 7.1 by circular arrow 705. In this case, the economics functions are provided by economics layer 834, with similar capabilities as described with respect to the economics layer 734 of FIG. 7.1. However, it will be appreciated that the economics functions may be provided by, for example, an economics module 720.2 of FIG. 7.2.

The oilfield modules 802.1-802.5 are positioned in the same application 804 as previously described with respect to the modules of FIG. 7.1 and 7.2. In this case, the models are within a single application and, therefore, share data and events to generate oilfield models 830. The external data source(s) 836, oilfield inputs/outputs 838 and report generator 840 are connected to the database 832 via database connections 844. Other components may also be operatively connected to the database. Data may be selectively exchanged between the components as desired. Safeties 837, such as firewalls, restricted access or other security measures, may be provided to restrict access to data as desired.

The modules may be connected to the database 832 to access and/or receive information as desired. The database 832 may be essentially the same as database 704 (depicted in FIG. 7.2) and/or 604 (depicted in FIG. 6.1), and may be provided with one or more external databases, such as or data sources 836, connected to database 832. Such external data source(s) may be libraries, client databases, government repositories or other sources of information that may be connected to the internal database. The external databases may be selectively connected and/or accessed to provide the desired data. Optionally, data may also be provided from the internal database to the external database as desired. Such data may be in the form of reports provided to outside sources via the external database.

The system of FIG. 8 is depicted as an open system that permits the addition of an extension 842 to add external functionality. As shown, the extension (or plug-in) 842 is connected to the drilling module 802.4 to add, for example, a casing design module 842. The casing design module adds functionality to the drilling module. For example, the extension may allow the drilling module to consider casing design in generating its drilling design for the earth model. Such extensions may be added using existing products, such as OCEAN™ Development Kit by SCHLUMBERGER™. One or more additional extensions may be provided to any of the modules in the system. Additionally, the system may be expanded to add entire modules within the system.

The oilfield inputs/outputs as depicted by 838 may be essentially the same as the oilfield inputs/outputs 601 described with respect to FIG. 6.2, except that the oilfield inputs/outputs 838 communicates with database 832 via database connection 844. In this manner, data from the oilfield may be fed into the database so that modeling operation may be updated with the new information as it is received, or at various intervals as desired. Optionally, the oilfield inputs/outputs may be or connected to one or more modules, databases or other components of the system.

The report generator 840 may be essentially the same as the report generator 607 depicted in FIG. 6.1, except that the report generator is now connected to internal database 832, rather than individual modules. Reports may be distributed to the oilfield, external database or other external locations as desired via database 832. Reports may also be directly provided by the Reports generator to the desired internal and/or external locations. Reports may be provided in the desired format, for example to third parties via external database 836, as desired.

The process used to create the oilfield model may be captured and provided as part of the reports. Such process reports may be provided to describe how the oilfield models were generated. Other data or results may also be provided. For example, a report may provide a final volumetric generated by the system. Additionally, the report may also include a statement of the calculated uncertainties, the selected sequence of processes that comprise the oilfield model, the dates operations were performed and decisions made along the way.

The modules are operatively connected by wavy arrows 826 depicting dynamic connections therebetween. While a specific configuration of modules is depicted in a specific order, it will be appreciated that a variety of connections, orders or modules may be used. This flexibility provides for designed modeling configurations that may be performed to defined specifications. Various combinations of modules may be selectively connected to perform the desired modeling. The various oilfield models generated by the various combinations of modules may be compared to determine the optimum process for performing the oilfield operations.

The wavy arrows 826 depict the process flow and knowledge sharing between the modules. Two or more of the individual modules may be operatively connected to share knowledge and cooperatively perform modeling. As shown, the connections are dynamic to enable unified operation, rather than just the independent operation of FIGS. 6.1 and 6.2 or the integrated operation of FIGS. 7.1 and 7.2. This dynamic connection between the modules permits the modules to selectively decide whether to take action based on modeling performed by another module. If selected, the module may use the dynamic connection to rerun a process based on updated information received from one or more of the other modules. When modules are dynamically connected, they form a network that enables the knowledge capture from dynamically connected modules and allows selective processing by the modules based on the knowledge sharing of the modules. A unified earth model may be generated based on the combined knowledge of the modules.

By way of example, when data is received indicating a change (e.g. a property in an earth model or a control setting), that change is propagated to all modules that are dynamically connected. The dynamically connected modules share this knowledge and perform their modeling based on the new information. The dynamic connections may be configured to permit automatic and/or manual updates to the modeling process. The dynamic connections may also be configured to permit changes and/or operational executions to be performed automatically when an event occurs that indicates new settings or new measurements are available. As queries are made to the oilfield model, or data changes such as additions, deletions and/or updates to the oilfield model occur, the dynamically connected models may perform modeling in response thereto. The modules share knowledge and work together to generate the oilfield models based on that shared knowledge.

The dynamic connections may be used to participate in the knowledge capture, and may be configured to enable automated modeling between the modules. The configuration of the connections may be tailored to provide the desired operation. The process may be repeated as desired so that the knowledge sharing and/or modeling is triggered by predefined events and/or criteria. As depicted, the dynamic connections have bi-directional flow between the selected modules. This permits the modeling operation to be performed in a desired sequence, forward or backwards. The dynamic connections are further provided with the capability of simultaneously performing the modeling operation.

For example, observations at a prediction stage of the dynamic modeling may affect parameterization and process selections further up the chain. In this example, predictive volumetrics of a model generated by a module may not match historical data thereby requiring changes to the model's conditions that create a large fluid volume. These suggested changes may point to any number of parameters that could result in a desired change effect.

Knowledge sharing between the modules may involve, for example, viewing the modeling operation from another module. The modules may work together to generate the oilfield modules based on a common understanding and interactive processing. Knowledge sharing may also involve the selective sharing of data from various aspects of the oilfield. For example, the reservoir engineer may now consider seismic data typically reviewed by the geophysicist, and the geologist may now consider production data typically used by the reservoir engineer. Other combinations may be envisioned. In some cases, users may provide inputs, set constraints, or otherwise manipulate the selection of data and/or outputs that are shared between the selected functions. In this manner, the data and modeling operations may be manipulated to provide results tailored to specific oilfield applications or conditions.

The modules may be selectively activated to generate a unified oilfield model 830. The unified oilfield model may contain, for example, a unified earth model 833. The unified earth model 833 may be essentially the same as the earth model 730.2 previously described in FIG. 7.2, except that it is generated by the modules dynamically connected for knowledge sharing. The oilfield model may further provide other model features, such as a surface model 831. In this case, the production engineer module, for example, may have additional information concerning the surface facility, gathering networks, storage facilities and other surface components which affect the oilfield operation. The production engineering and (optionally) other modules may use this data to generate a unified surface model. The surface model may define, for example, the mechanical facilities necessary for the production and distribution of the subsurface reservoir, such as the gathering networks, storage facilities, valves and other surface production facilities. Thus, the selected modules may be used to generate a unified oilfield model based on the combined earth and surface models, or other desired model generated by activation of the selected modules.

To optimize modeling outputs, it may be possible to leverage data and other information from one or more of the modules. For example, the reservoir engineering data relating to dynamic fluid production may be used to enhance the oilfield model by simulating how the measured fluids will flow through the various models. How accurately each model's flow simulation matches the known historical production measurements may be observed and measured. Typically, the better the history production simulation match, the higher likelihood there will be of a future production match. A more accurate future match may be required for planning expenditures on well recompletions, drilling of new wells, modifying surface facilities, or planning economic recoverable hydrocarbons.

In another example, the relationship between the static and dynamic portions of the reservoir characterization module may be leveraged to optimize the oilfield model. The reservoir characterization module may have a static and dynamic model that provides the best historical match of a reservoir's production. No matter how good the match, the model may require recalibration over the course of time as more wells are drilled, or new production information is acquired. If newly observed data no longer matches the static model, then it may be unnecessary to update to more accurately predict the future. In cases where a well's measured production rate is suddenly less than predicted, this can be an indication that the reservoir compartment is not as large as once thought. Based upon this production observation the reservoir engineer can query the geologist to investigate and update to the model's porosity, or query the geophysicist to see whether the initial ceiling height of the formation boundaries may be overly optimistic and in need of revising downward. The updates provided may be used to facilitate knowledge refinement, and enable reverse processing to update the oilfield model.

FIGS. 9.1 and 9.2 are flow charts depicting methods of performing an oilfield operation. FIG. 9.1 depicts a method 900.1 for performing an oilfield operation involving collecting oilfield data 902, positioning a plurality of oilfield modules in a single application 903, selectively connecting the oilfield modules for interaction therebetween 904, and generating oilfield model(s) using the oilfield modules and the oilfield data 906.

The data may be collected in one or more databases 902. As shown in FIG. 8, the databases may be internal database (see, e.g., database 832 depicted in FIG. 8) and/or an external database (see, e.g., database 836 depicted in FIG. 8). The collection of oilfield data may be performed as described previously. Data may be collected at various times, and the models generated throughout the process may be selectively updated as new data is received. Constraints may be placed on the collection of data to selectively restrict the type, quantity, flow or other characteristics of the incoming data to facilitate processing. Optionally, the data may be collected and/or displayed in real time. The data and/or models may be selectively stored in databases at various intervals throughout the analysis. The process performed throughout the method may also be stored. A trail depicting the process is created, and may be replayed at specific intervals as desired. The various inputs, outputs and/or decisions made throughout the process may be viewed. Snapshots of the analysis may be selectively replayed. If desired, the process may be re-performed using the same or other data. The process may be adjusted and re-stored for future use. Reports of stored data, models and/or other information contained in the database may be provided, for example, by the report generator 840 depicted in FIG. 8.

The plurality of oilfield modules is positioned in an application (903) as shown, for example, in FIG. 8. When placed in the same application as shown in FIGS. 7.1, 7.2, and 8, the modules are able to share data and events without the requirement of passing them from one to the other as shown in FIGS. 6.1 and 6.2. The modules are also able to see the modeling operation performed by the other modules. In some cases, it may be desirable to access modules positioned in separate applications (not shown). For example, the system of FIG. 7.1 may be operatively connected to the system of FIG. 6.2 using a system connection to pass data and events therebetween. This may be desirable in situations where modeling of oilfield data is performed by two separate systems. The models generated by the separate systems may be combined to generate one or more common earth models based on both systems. Modeling may, therefore, be performed across multiple applications with a system connection therebetween.

The oilfield modules are selectively connected 904 for interaction therebetween. The modules may be connected, for example, by dynamically connections for unified operation (e.g. FIG. 8), integrated connections for integrated operation (e.g. FIG. 7.2), module connections for shared operation (e.g. FIG. 7.1), and/or database or module connections for passing data and/or events therebetween (e.g. FIGS. 6.1, 6.2). Each of the modules is capable of performing modeling operations relating to the oilfield. In some cases, the modules work independently (e.g. FIGS. 6.1, 6.2), are integrated for integrated operation (e.g. FIGS. 7.1-7.2) or are unified for shared knowledge and unified operation (e.g. FIG. 8). One or more of the modules may be selected to perform the desired operation. For example, a unified earth model 833 may be generated using only the reservoir characterization, geophysics and reservoir engineering modules 802.1, 802.2, and 802.5 operatively connected using, for example, the dynamic connections 826 of FIG. 8. Other configurations of selected modules may be connected using one or more selected connections to generate the desired model(s). The selective connecting of the modules permits flexible design for the selective interaction between the modules.

The desired modeling of the data is preferably performed by selectively performing modeling of various functions, such as those depicted in FIG. 8. This may be done by selecting oilfield modules for generating models based on a desired result. By way of example, certain models, such as the static models of FIGS. 4.1-4.3, may be generated. These static models are generated using, for example, the reservoir characterization 720.1 and geophysics modules 720.3 operatively connected by integrated connections 726 as shown in FIG. 7.2 to model a portion of the oilfield data relating to static data used by the geologist and/or geophysicist functions. Other combinations of modules may be used to generate models generated relating to specific portions of the oilfield. The method permits the selection of a variety of modules to generate models for use in the integrated analysis. Depending on the combination of modules, the resulting models may be used to generate output relating to any portion or all of the oilfield.

An oilfield model, such as the oilfield model 830 of FIG. 8, is generated by selectively performing modeling using the connected oilfield modules 906. As described with respect to FIG. 8, the selected modules may work together to generate the oilfield model using the knowledge sharing of the data, events and models generated within the application. The modeling may also be performed using the integrated systems of FIGS. 7.1 and 7.2, the independent systems of FIGS. 6.1 and 6.2 or others. The oilfield model may be an earth model and/or other model, such as a surface model as described with respect to FIG. 8. Oilfield data may be selectively accessed by the oilfield models as desired, such as continuously, discretely or in real time, to generate and/or update models. The modeling process may be performed iteratively, until a predetermined criteria is met (e.g. time) or until convergence is achieved. Multiple oilfield models may be generated, and some or all may be discarded, compared, analyzed and/or refined. The multiple oilfield models preferably provide uncertainties as previously described with respect to FIG. 7.2.

Preferably, an optimized oilfield model is generated that maximizes all predetermined criteria and/or objectives of the oilfield operation. An optimum oilfield model may be generated by repeating the process until a desired model is generated. Selected models may be operatively connected to generate models using certain data in a certain workflow. The process and configuration of the operation may be adjusted, repeated and analyzed. Multiple models may be generated, compared and refined until a desired result is achieved. The process used to generate the desired oilfield model may be refined to define an optimum process for a given scenario. The selected connection of certain modules may be combined to perform the desired operation according to the optimum process. Once an optimum process is determined, it may be stored in the database and accessed for future use. The optimum process may be adapted for certain situations, or refined over time.

An oilfield plan may be generated based on the generated oilfield model 908. In some cases, an oilfield plan may include a design of part or all of the oilfield operation. The oilfield plan may define the requirements for performing various oilfield operations, such as drilling, well placement, well completions, well stimulations, etc. The generated oilfield models may predict, for example, the location of valuable reservoirs, or obstacles to obtaining fluids from such reservoirs. The models may also take into consideration other factors, such as economics or risks that may affect the plan. The oilfield plan is preferably optimized based on the generated oilfield model(s) to provide a best course of action for performing the oilfield operations.

The oilfield plan may be generated by the system (e.g. 800 of FIG. 8). Alternatively, the oilfield models generated by the system may be passed to a processor, for example in the surface unit (134 of FIGS. 1.2-1.4). The processor may be used to generate the oilfield plan based on the generated oilfield models.

The oilfield plan may be implemented at the oilfield 910. The oilfield plan may be used to make decisions relating to the oilfield operation. The oilfield plan may also be used to take action at the oilfield. For example, the oilfield plan may be implemented by activating controls at the wellsite to adjust the oilfield operation. The oilfield models, plans and other information generated by the system (e.g. 800 of FIG. 8) may be communicated to the oilfield via the oilfield inputs/outputs 838. The surface unit (134 of FIGS. 1.2-1.4) may receive the information and perform activities in response thereto. In some cases, the surface unit may further process the information to define commands to be performed at the wellsite. Actions, such as changes in equipment, operating settings, trajectories, etc., may be performed at the wellsite in response to the commands. Such actions may be performed manually or automatically. The well plan may also be implemented by the surface unit by communicating with controllers at the wellsite to actuate oilfield equipment to take action as desired. In some cases, oilfield actions, such as drilling a new well, or terminating production may also be performed.

The oilfield operations may be monitored to generate new oilfield data 912. Sensors may be located at the oilfield as shown in FIGS. 1.1-1.4. Information from the oilfield may be passed to the system 800 by the oilfield inputs/outputs 838 as shown, for example, in FIG. 8. As new data is collected, the process may be repeated 914. The new data may suggest that changes in the oilfield plan, the system, the process, assumptions in the process and/or other parts of the operation may need adjustment. Such adjustments may be made as necessary. The data collected and the processes performed may be stored and reused over time. The processes may be re-used and reviewed as needed to determine the history of the oilfield operations and/or any changes that may have occurred. As new models are generated, it may be desirable to reconsider existing models. The existing oilfield models may be selectively refined as new oilfield models are generated.

Boxes 902-912 may be repeated 914, as desired. For example, it may be desirable to repeat the boxes based on new information, additional inputs and other factors. New inputs may be generated using data acquisition tools at the existing oilfield sites and/or at other locations along the oilfield. Other additional data may also be provided. As new inputs are received, the process may be repeated. The data collected from a variety of sources may be collected and used across other oilfields. The boxes may also be repeated to test various configurations and/or processes. Various outputs may be compared and/or analyzed to determine the optimum oilfield model and/or process.

Reports of the data, modeling operation, plans or other information may be generated 916. The reports may be generated using, for example, the integrated report generator (see, e.g. 840 of FIGS. 8 or 607 of 6.1). The reports may be generated at any time during the operation and in any desired format. The reports may be tailored to a desired format and adjusted as needed. The reports may provide data, results, processes and other features of the operation. Reports, visualizations and other displays may be generated for use by on or offsite users. Such displays may provide multidimensional images of modeling and/or simulation operations. The reports generated may be stored, for example in databases 832, 836 of FIG. 8. The reports may be used for further analysis, for tracing the process and/or analyzing operations. The reports may provide various layouts of real-time, historical data, monitored, analyzed, modeled and/or other information.

FIG. 9.2 depicts a method 900.2 for performing an oilfield operation involving collecting oilfield data 922, positioning a plurality of oilfield modules in a single application 919, selectively connecting the oilfield modules for interaction therebetween 924, and generating oilfield model(s) by performing modeling using the oilfield modules and the oilfield data 926.

In this method 900.2, the oilfield data is collected in a plurality of databases 922. The databases are similar to those described with respect to box 902 of FIG. 9.1. The data may be preprocessed 921 to ensure the quality of the data. Calibrations, error checks, scaling, filtering, smoothing, validation, and other quality checks may be performed to verify and/or optimize the data. The data may also be translated, converted, mapped, packaged or otherwise conformed to facilitate processing. In some cases, certain data may be used that is of a specific type, such geological data, geophysical data, reservoir engineering data, production data, drilling data, economic data, and/or petrophysical data, and may be selectively sorted and stored for use.

The modules may be placed in an application 919 as previously described with respect to box 903. The oilfield modules may be selectively connected 924 as previously described with respect to box 904 of FIG. 9.1.

One or more of the selected modules may optionally be provided with additional functionality 923. The added functionality may be added via at least one extension, such as extension 842 of FIG. 8. Economics functionality may also be added for performing economics modeling 925. This functionality may be added as a module (see, e.g., module 720.2 of FIG. 7.2) or as a layer (see, e.g., layer 834 of FIG. 8). The added functionality of the extension and/or economics may be performed at any time through the process as desired. Preferably, these functionalities are used to assist in the optimization of the oilfield model.

One or more oilfield models may be generated 926 as previously described with respect to box 906 of FIG. 9.1. The method may further involve generating an oilfield plan 928, implementing the oilfield plan 930, monitoring the oilfield operations 932, generating reports 936 and repeating the process 934. These boxes may be performed as previously described with respect to boxes 910, 912, 916, and 914, respectively, of FIG. 9.1.

The oilfield plan may be adjusted 933 during the process. As new data is received, or the modeling operation proceeds, the oilfield plan may need adjustment. New data may indicate that conditions at the oilfield have changed, and the oilfield plan may need to adapt to those changes. The modeling process may be refined, resulting in different oilfield models which suggest changes to the oilfield plan. The oilfield plan may be automatically or manually adjusted based on new data, results, criteria or for other reasons.

At least some boxes may be performed simultaneously or in a different order. As shown in FIGS. 9.1 and 9.2, the reports may be generated before and/or after the boxes are repeated. It will be appreciated that the reports may be performed at any time as desired. Other boxes, such as the collection of oilfield data, the preprocessing of data, the implementation of the oilfield plan and other boxes may be repeated and performed at various times throughout the process.

Figure 10:
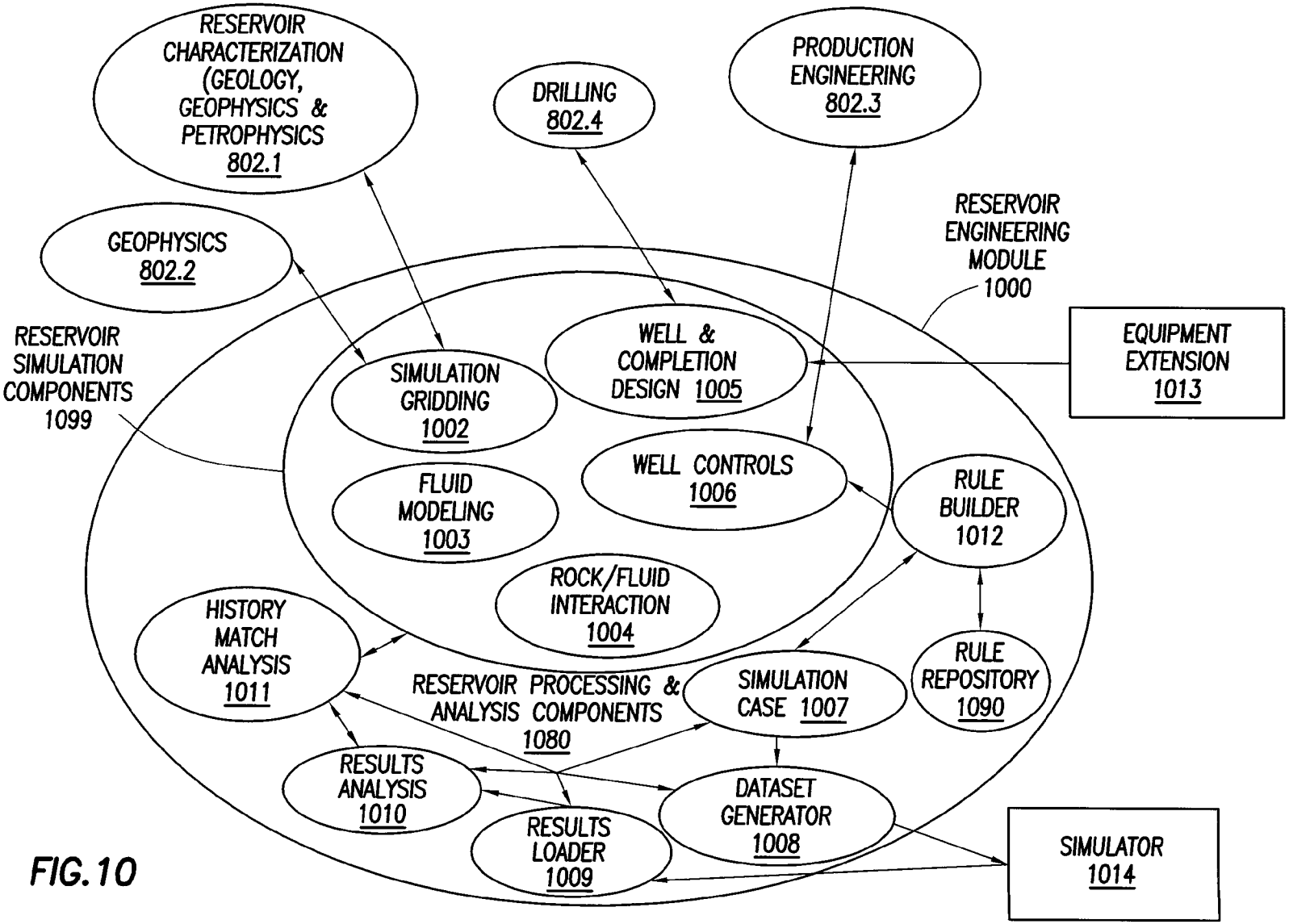
FIG. 10 depicts a system for reservoir engineering.

FIG. 10 depicts a reservoir engineering system. The reservoir engineering system 1000 may have essentially the same functionality of the reservoir engineering module 802.5, discussed above in reference to FIG. 8. The reservoir engineering system 1000 may have multiple reservoir simulation components 1099 including a simulation gridding module 1002, a fluid modeling module 1003, a rock/fluid interaction module 1004, a well and completion design module 1005, and a well controls module 1006. The reservoir engineering system 1000 also includes a rule builder 1012 associated with a rule repository 1090. The reservoir engineering system 1000 may also have reservoir processing and analysis components 1080 including a simulation case module 1007, a dataset generator 1008, a results loader 1009, a results analysis module 1010, and a history match analysis module 1011. Each of these reservoir engineering components are described below and may be located on the same device (e.g., a server, mainframe, desktop PC, laptop, PDA, television, cable box, satellite box, kiosk, telephone, mobile device, etc.) or may be located on separate devices connected by a network (e.g., the Internet) with wired and/or wireless segments. The components of the reservoir engineering system 1000 may exchange simple data and/or functional knowledge between each other and/or modules external to the reservoir engineering system 1000 (e.g., drilling module 802.4, production engineering module 802.3, reservoir characterization module 802.1, geophysics module 802.2, etc.).

The simulation gridding module 1002 may be configured to interact with the reservoir characterization module 802.1, discussed above in reference to FIG. 8. The simulation gridding module 1002 may be configured to transform a grid describing the geometry and rock properties of a reservoir in the oilfield. In other words, the simulation gridding module 1002 can selectively increase or decrease the resolution of the grid in portions of the reservoir where little flow is expected (e.g., in the underlying water zone) or where rapid flow is expected (e.g., immediately around wells). Examples of gridding techniques that may be implemented by the gridding module 1002 are provided in U.S. Pat. Nos. 6,106,561; 6,108,497; and 6,078,869.

The fluid modeling module 1003 may be configured to model fluids in the reservoir, including variations in fluid properties (e.g., viscosity, composition, etc.) with respect to pressure and temperature, using fluid data collected from the oilfield and/or using correlations based on data gathered from analogous oilfields. The fluid models may be expressed in tabular form (commonly known as the "black oil" approach) or as inputs to an equation of state (commonly known as the "compositional" approach). Examples of fluid analysis techniques involving black oil and/or compositional fluids that may be implemented by the fluid modeling model 1003 are described in U.S. Pat. No. 7,164,990 and US Patent Publication No. US2007/0061087.

The fluid modeling module 1003 may model the fluids in the reservoir assuming a constant reservoir temperature (isothermal) or varying temperature. The latter approach is used when modeling reservoir processes such as steam injection, in-situ combustion or other chemical reactions, where heat energy is supplied to the reservoir in order to raise the temperature of the oil in order to reduce its viscosity and thus increase the fluid mobility. The tabular data if using a black oil model, or the parameters of the equation if using an equation of state, may be matched to laboratory experiments using mathematical regression techniques.

Figure 11:
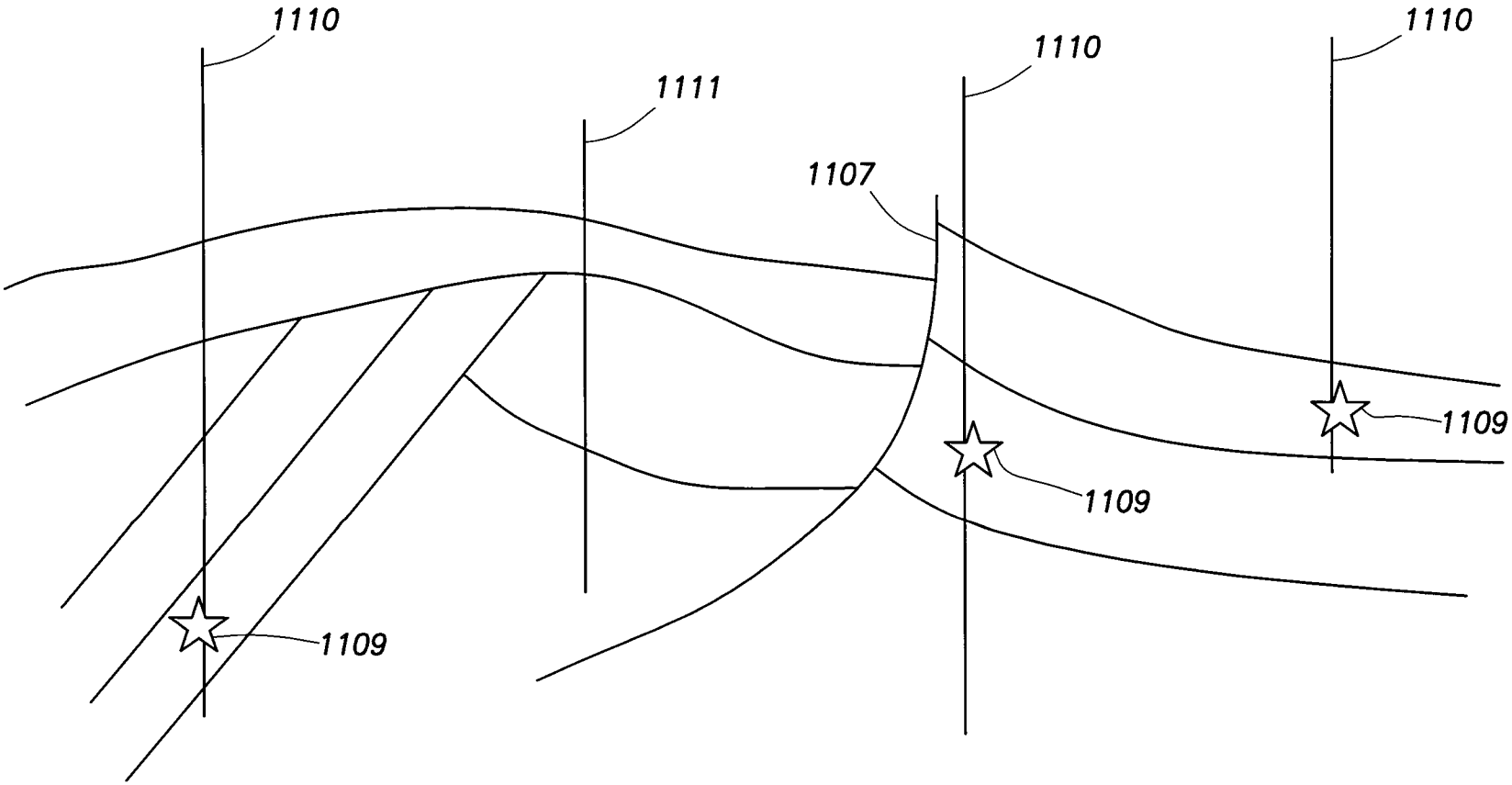
FIG. 11 depicts the collection of fluid samples in the field.

FIG. 11 depicts the collection of one or more fluid samples in the oilfield for generating a fluid model using an equation of state. The vertical lines 1110, 1111 represent wells, the stars 1109 represent the source of fluid samples, and the curved line 1107 represents a postulated geological barrier. As depicted in FIG. 11, typically a few fluid samples 1109 are available from only a few widely spaced wells. The few fluid samples may be used to generate a fluid model describing how the fluid composition varies aerially and with depth within the reservoirs of the oilfield, including in the wells in which no sample was obtained 1111. In order to correctly generate and/or calibrate the fluid model, it may be necessary to determine whether the samples were actually obtained from a single connected fluid system, or from multiple fluid systems isolated by geological features (i.e., the postulated geological barrier 1109).

The fluid modeling module 1003 may be configured to predict, using standard thermodynamic principles of composition and pressure variation with depth, fluid compositions at each sample location, and to compare the tabulation of predicted compositions with actual fluid composition data collected from a few depths.

The fluid modeling module may use 3D visualization to show surfaces of constant composition or saturation pressure. Based on said surfaces, it may be possible to verify that the samples belong to a single connected fluid system, or to identify likely geological features that separate different fluid systems (i.e., the postulated geological barrier 1109). The full set of data from the geological characterization (i.e., generated by the reservoir characterization module 802.1) is available for visualization alongside the fluid model, enabling a holistic evaluation of the data to be made and an interpretation of the subsurface that is consistent with all available data.

Referring back to FIG. 10, the rock/fluid interaction module 1004 may be configured to model the interactions between the fluid and rock of the reservoir based on the surface chemistry of the rock and data collected from the oilfield and/or analogous oilfields. The collected data may include relative permeability data (i.e., data describing how the mobility of one fluid is reduced by the presence of another fluid), capillary pressure data (i.e., data describing presence of saturation (e.g., of water) at a height above the contact due to surface tension effects in porous media), adsorption/desorption tables (i.e., data describing how methane gas is released from coal), etc. Interactions described by the model may include fluid of the reservoir effectively sticking to the rock, fluid of the reservoir being repelled by the rock, and/or fluid of the reservoir being trapped in pores of the rock. In addition, the model may be used to predict the initial distribution of reservoir fluids for comparison to the collected oilfield data and refined until a match is obtained.

The equipment extension module 1013 may be external to the reservoir engineering system 1000 and store models of wellbore equipment for use in the oilfield. Each model in the equipment extension module 1013 provides a generic interface to the corresponding wellbore equipment allowing interaction with the wellbore equipment without specific knowledge of the implementation details (i.e., encapsulation). In addition, each model provides a description of how the wellbore equipment should be represented in a simulator. In other words, each model provides a description of the wellbore equipment that may be translated into simulator instructions when generating a dataset (discussed below). Said models of wellbore equipment in the equipment extension module 1013 may be provided by the vendors of the wellbore equipment or other third parties. New models may be added to the equipment extension module 1013 while existing modules may be altered and/or deleted. The equipment extension module 1013 may be referred to as an extender and/or a tailoring mechanism.

The well and completion design module 1005 may be configured for use in designing wellbore trajectories through the reservoir and completion strings within said trajectories based on the data collected from the oilfield and/or gathered from analogous oilfields. In addition, the well completion design module 1005 is configured to interact with the equipment extension module 1013 so that wellbore equipment may be selected from the equipment extension module 1013 for use in designing said wellbore trajectories and said completion strings.

As depicted in FIG. 10, the well and completion design module 1005 may also be configured to interact with the drilling module 802.4, discussed above in reference to FIG. 8. When designing completions for wells not yet drilled, there may be uncertainty as to the exact locations of geological horizons in the oilfield. The well and completion design module 1005 allows the position(s) of wellbore equipment to be specified relative to a geological horizon in the oilfield, instead of, or in addition to, an absolute depth along the wellbore. This allows the wellbore equipment to be automatically re-positioned when the geological model is updated, including an update to the locations of the geological horizons, following acquisition of new oilfield data, or when perturbations are applied to the locations of the geological horizons to quantify the impact of the uncertainty in the positions of those horizons. Further, the well and completion design module 1005 is configured to exchange the relationships between geological horizons and wellbore equipment positions with the drilling module 802.4.

The well controls module 1006 may be configured to specify how wells in the oilfield are to be controlled (e.g., by pressure and/or rate). In other words, the well controls module 1006 includes rules to specify how wells in the oilfield are to be controlled. For example, the rules may specify pressure and/or rate limits, pressure and/or rate targets, and actions to be taken (e.g., drilling additional wells, performing remedial modifications to existing wells), once the limits are breached and/or the targets are achieved.

Although one or more rules may be included with well controls module 1006, the rule builder 1112 may be used to define tailored rules for use with the well controls module 1006. The tailored rules may require one or more parameters may be provided before the tailored rules can be used to generate logic controls for use in simulating models of the oilfield. Once the tailored rules are generated, the tailored rules may be accessed in essentially the same manner as the rules included with well controls module 1006. Further, the tailored rules may be stored in a rules repository (i.e., a library) (not shown), and the repository may include many implementations of the same rule for different simulators.

In one example of reservoir engineering, a tailored rule maybe generated by advanced users capable of defining the complicated and bespoke logic of the customized rule. A less sophisticated user may select the customized rule and provide the necessary parameters for use with well controls module 1006. The rule builder 1112 may be referred to as an extender and/or a tailoring mechanism.

Still referring to FIG. 10, the user may create a multitude of alternative versions of each of these oilfield models (i.e., fluid model, rock/fluid interaction model, etc.). The simulation case 1007 may be a single coherent instance of the models assembled by a user.

The dataset generator 1008 may be configured to generate a simulator dataset based on the simulation case 1007 and launch a simulator (e.g., Simulator 1014). When one or more customized rules have been defined (discussed above), the dataset generator 1008 refers to the rules repository (discussed above) to obtain the implementation of the rule for the particular simulator being executed.

Either during the running of the simulator 1014, which may take anything from minutes to days duration depending on the complexity of the model and length of time to be simulated, or on completion of the simulation run, the system may load the results directly from the simulator output files to the graphical display 1010 using the results loader 1009. The graphical display 1010 may have a variety of graphical displays including line plots for items such as rates versus time, 3D plots for display of fluid distribution within the reservoir, log displays for fluid movement within the wellbore, etc.

Before the dynamic model is used for predictions it is common to simulate the period of historical production and compare the simulation to historical observations of quantities, such as pressure, water and gas rates, etc. The history match analysis module 1011 is configured to compute the root mean square error between the simulated and observed data. Said root mean square error can be plotted to identify wells whose performance is poorly simulated. It can also be plotted vs. simulation case for many cases, allowing the best matched case to be identified. Adjustments are then made to the various data comprising the dynamic model to improve the match. Such adjustments may be made directly by the user, or by an automated procedure. Once a satisfactory match is obtained the model may be used for predictions.

While specific components are depicted and/or described for use in the units and/or modules of the well and completion design module 1005, it will be appreciated that a variety of components with various functions may be used to provide the formatting, processing, utility and coordination functions necessary to provide reservoir engineering in the well and completion design module 1005. The components may have combined functionalities and may be implemented as software, hardware, firmware, or combinations thereof.

FIG. 12.1 depicts a flowchart for performing reservoir engineering. One or more boxes of the process depicted in FIG. 12.1 may be executed by a reservoir engineering system (e.g., reservoir engineering system 1000 discussed above in reference to FIG. 10). Initially, oilfield data is collected (box 1202). The oilfield data (e.g., seismic data) may be collected from a plurality of sensors positioned about the oilfield.

In box 1204, a geological model of the reservoir is generated using the collected oilfield data. The model includes one or more geological horizons separating one or more geological zones in the oilfield. The actual locations (e.g., depths) of the geological horizons in the oilfield may not be precisely known, and thus the location of the geological horizons in the model is estimated based on the collected oilfield data (e.g., seismic data).

In box 1206, wellbore equipment is positioned relative to the geological horizons as part of a well completion design. In other words, the positions of wellbore equipment in the well completion design is not specified as an absolute depth from the surface, but rather as some offset from a geological horizon in the geological model. For example, the position of some wellbore equipment may be specified as 12 feet below geological horizon 1. As another example, the position of other wellbore equipment may be specified as 25 feet above geological horizon 3. By specifying the positions of wellbore equipment relative to a geological horizon (i.e., instead of at an absolute depth from the surface), the absolute positions of wellbore equipment in the model may be automatically updated when the geological model is improved (e.g., through additional collected data) to more accurately reflect the actual locations of geological horizons in the oilfield or when perturbations are applied to the locations of the geological horizons to quantify the impact of the uncertainty in the positions of those horizons (discussed below).

In box 1208, the absolute positions of the wellbore equipment (e.g., relative to the surface) are calculated using the geological model of the reservoir. In other words, using the offsets provided in box 1206 and the estimated locations of geological horizons from the geological model, the absolute positions of wellbore equipment in the well completion design is calculated.

In box 1210, it is determined whether the geological model has been updated (e.g., following collection of additional oilfield data). The updated geological model may include new estimates for the locations of geological horizons (i.e., locations further or closer to the surface than previously modeled). When it is determined that the geological model has been updated, the process returns to box 1208 for recalculation of the absolute positions of the wellbore equipment. Otherwise, when it is determined that the geological model has not been updated (or the geological model has been updated without changing the previous positions of the geological horizons), the process proceeds to box 1212.

In box 1212, a simulation case including the geological model and the well completion design is simulated (e.g., using external simulator 1014 in FIG. 10). The simulation results may include line plots for items such as rates versus time, 3D plots for the display of graphical distribution within the reservoir, log displays for fluid movement within the wellbore, production profiles of the reservoir, etc.

Although the example process in FIG. 12.1 is focused on the positioning of wellbore equipment relative to geological horizons, it may also be possible to specify the positions of wellbore operations/processes (e.g., hydraulic fracturing, an oilfield perforation operation, acidization, chemical treatment, cement squeeze, etc.) relative to geological horizons (i.e., instead of absolute depths from the surface) in the geological model of the reservoir.

FIG. 12.2 depicts a flowchart for performing reservoir engineering. One or more boxes of the process depicted in FIG. 12.2 may be executed by a reservoir engineering system (e.g., reservoir engineering system 1000 discussed above in reference to FIG. 10). Initially, oilfield data is collected in box 1214. The oilfield data (e.g., seismic data) may be collected from a plurality of sensors positioned about the oilfield. Box 1214 may be essentially the same as box 1202, discussed above in reference to FIG. 12.1. However, the collected oilfield data may also include reservoir fluid samples collected from selected wells at selected depths in the oilfield. The selected well and depths may only represent a small percentage of the wells and depths in the oilfield.

In box 1218, a model of the fluid and rock properties of the reservoir, and the interactions between the fluids and rocks, is generated. The model may be expressed in tabular form or as inputs to an equation of state. One approach to modeling the fluid and rock properties/interactions includes using standard thermodynamic principles of composition and pressure variations at each sample location to predict compositions at alternate depths, and then comparing the predictions with the actual compositions at said alternate depths.

In box 1220, a 3D visualization showing surfaces of constant composition or saturation pressure is generated using the model of the fluid and rock properties. A geological model (e.g., the generated geological model in box 1204, discussed above in reference to FIG. 12.1) may be included in the 3D visualization and the appropriate portions of the geological model placed along side the surfaces.

In box 1222, it is determined using the 3D visualization whether the collected fluid samples originate from a single connected fluid system or multiple fluid systems. When it is determined that the collected fluid samples originate from a single connected fluid system, the process proceeds to box 1226. When it is determined that the collected fluid samples originate from multiple fluid systems, the process proceeds to box 1224.

In box 1224, the geological barrier responsible for isolating the multiple fluid systems is identified based on the 3D visualization. The geological model of the reservoir is updated to include the geological barrier.

In box 1226, a simulation case including the geological model and the fluid and rock properties model is simulated (e.g., using external simulator 1014 in FIG. 10). The simulation results may include line plots for items such as rates versus time, 3D plots for the display of graphical distribution within the reservoir, log displays for fluid movement within the wellbore, production profiles of the reservoir, etc.

FIG. 12.3 depicts a flowchart for performing reservoir engineering. One or more boxes of the process depicted in FIG. 12.3 may be executed by a reservoir engineering system (e.g., reservoir engineering system 1000 discussed above in reference to FIG. 10). Initially, oilfield data is collected from the oilfield (box 1228) and a geological model is generated based on the collected oilfield data (box 1230). The oilfield data (e.g., seismic data) may be collected by various sensors placed about the oilfield. Boxes 1228 and 1230 may be essentially the same as boxes 1202 and 1204, respectively, discussed above in reference to FIG. 12.1.

In box 1232, a tailored rule is defined using the native syntax of a simulator (e.g., external simulator 1014 in FIG. 10). The tailored rule may require one or more parameters as inputs, and may specify how wells in the oilfield are to be controlled. For example, the tailored rule may specify pressure and/or rate limits, pressure and/or rate targets, and actions to be taken (e.g., drilling additional wells, performing remedial modifications to existing wells), once the limits are breached and/or the targets are achieved. The tailored rule may be defined by an expert and/or stored in a rule repository for access by other users. The rule repository may include implementations of the same rule for different simulators.

In box 1234, the tailored rule is selected (e.g., by an end user) and applied to one or more input parameters (e.g., parameters specified by the end user) to generate a logic control (e.g., a custom well control). The logic control is used for simulation of the reservoir.

In box 1240, a simulation case including the geological model and the custom well control is simulated (e.g., using external simulator 1014 in FIG. 10). The simulation results may include line plots for items such as rates versus time, 3D plots for the display of graphical distribution within the reservoir, log displays for fluid movement within the wellbore, production profiles of the reservoir, etc.

Although the example in FIG. 12.3 is focused on generating a tailored rule after generating the model of the oilfield, the tailored rule may be defined at any time prior to the end user selecting the tailored rule and providing the one or more parameters required by the tailored rule.

FIG. 12.4 depicts a method for performing reservoir engineering. One or more boxes of the process depicted in FIG. 12.4 may be executed by a reservoir engineering system (e.g., reservoir engineering system 1000 discussed above in reference to FIG. 10). Initially, oilfield data is collected from the oilfield (box 1242) and a model of the reservoir is generated based on the collected oilfield data (box 1244). The oilfield data (e.g., seismic data) may be collected by various sensors placed about the oilfield. Boxes 1242 and 1244 may be essentially the same as boxes 1202 and 1204, respectively, discussed above in reference to FIG. 12.1.

In box 1246, one or more pieces of wellbore equipment are selected as part of a well completion design. Each piece of wellbore equipment may be represented by a model provided by the manufacturer of the wellbore equipment (e.g., as a plug-in). The model provides a generic interface to the corresponding wellbore equipment item allowing interaction with the wellbore equipment item without specific knowledge of the implementation details (i.e., encapsulation). Further, the model describes the behavior of the corresponding wellbore equipment (e.g., using mathematical expressions).

In box 1248, the simulator which will be performing the simulation is identified and simulator-specific instructions for modeling the one or more pieces of wellbore equipment are obtained. The simulator-specific instructions are used by the simulator to correctly model the behavior of the wellbore equipment during simulation. The simulator-specific instructions may be obtained by translating the description of the wellbore equipment item provided by the equipment model. Alternatively, an equipment model for a wellbore equipment item may already include the simulator-specific instructions.

In box 1250, a simulation case including the geological model, the well completion, and the simulator-specific instructions is simulated (e.g., using external simulator 1014 in FIG. 10). The simulation results may include line plots for items such as rates versus time, 3D plots for the display of graphical distribution within the reservoir, log displays for fluid movement within the wellbore, production profiles of the reservoir, etc.

As FIGS. 12.1-12.4 are all focused on performing reservoir engineering, portions of one or more boxes from any of FIGS. 12.1-12.4 may be combined in various orders to form an overall process for performing reservoir engineering. Further, the portions of the boxes may be implemented as software, hardware, firmware, or combinations thereof.

Figure 13:
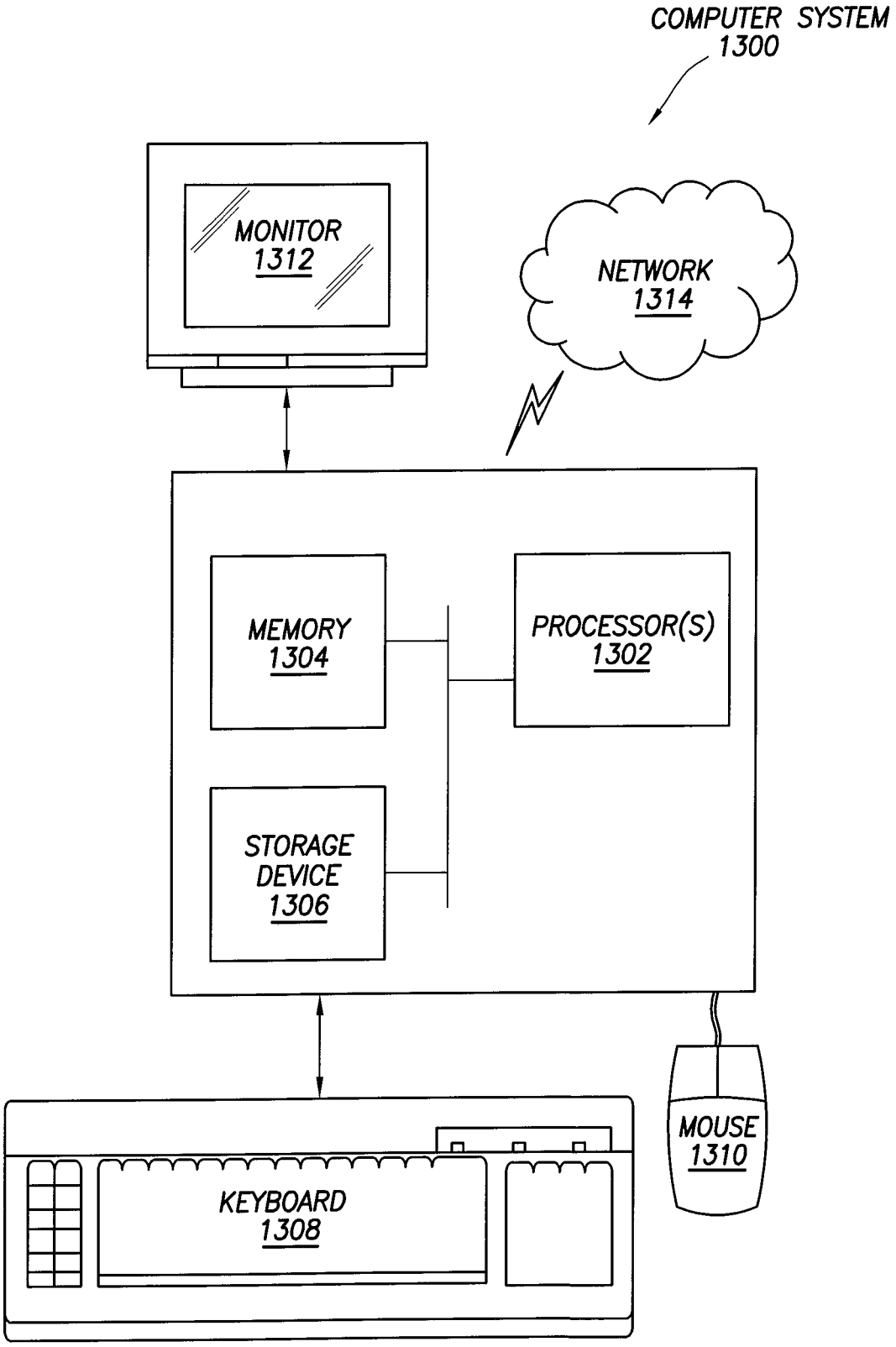
FIG. 13 depicts a computing system into which implementations of various techniques described herein may be implemented in accordance with one or more embodiments.

Reservoir engineering (or portions thereof), may be implemented on virtually any type of computer regardless of the platform being used. For example, as shown in FIG. 13, a computer system 1300 includes one or more processor(s) 1302, associated memory 1304 (e.g., random access memory (RAM), cache memory, flash memory, etc.), a storage device 1306 (e.g., a hard disk, an optical drive such as a compact disk drive or digital video disk (DVD) drive, a flash memory stick, etc.), and numerous other elements and functionalities typical of today's computers (not shown). The computer system 1300 may also include input means, such as a keyboard 1308, a mouse 1310, or a microphone (not shown). Further, the computer system 1300 may include output means, such as a monitor 1312 (e.g., a liquid crystal display (LCD), a plasma display, or cathode ray tube (CRT) monitor). The computer system 1300 may be connected to a network 1314 (e.g., a local area network (LAN), a wide area network (WAN) such as the Internet, or any other similar type of network) with wired and/or wireless segments via a network interface connection (not shown). Those skilled in the art will appreciate that many different types of computer systems exist, and the aforementioned input and output means may take other forms. Generally speaking, the computer system 1300 includes at least the minimal processing, input, and/or output means necessary to practice one or more embodiments.

Further, those skilled in the art will appreciate that one or more elements of the aforementioned computer system 1300 may be located at a remote location and connected to the other elements over a network. Further, one or more embodiments may be implemented on a distributed system having a plurality of nodes, where each portion may be located on a different node within the distributed system. In one or more embodiments, the node corresponds to a computer system. Alternatively, the node may correspond to a processor with associated physical memory. The node may alternatively correspond to a processor with shared memory and/or resources. Further, software instructions for performing one or more embodiments of reservoir engineering may be stored on a computer readable medium such as a compact disc (CD), a diskette, a tape, or any other computer readable storage device.

The systems and methods provided relate to acquisition of hydrocarbons from an oilfield. It will be appreciated that the same systems and methods may be used for performing subsurface operations, such as mining, water retrieval and acquisition of other underground materials. Further, the portions of the systems and methods may be implemented as software, hardware, firmware, or combinations thereof.

While specific configurations of systems for performing oilfield operations are depicted, it will be appreciated that various combinations of the described systems may be provided. For example, various combinations of selected modules may be connected using the connections previously described. One or more modeling systems may be combined across one or more oilfields to provide tailored configurations for modeling a given oilfield or portions thereof. Such combinations of modeling may be connected for interaction therebetween. Throughout the process, it may be desirable to consider other factors, such as economic viability, uncertainty, risk analysis and other factors. It is, therefore, possible to impose constraints on the process. Modules may be selected and/or models generated according to such factors. The process may be connected to other model, simulation and/or database operations to provide alternative inputs.

It will be understood from the foregoing description that various modifications and changes may be made in the preferred and alternative embodiments of reservoir engineering without departing from its true spirit. For example, during a real-time drilling of a well it may be desirable to update the oilfield model dynamically to reflect new data, such as measured surface penetration depths and lithological information from the real-time well logging measurements. The oilfield model may be updated in real-time to predict the location in front of the drilling bit. Observed differences between predictions provided by the original oilfield model concerning well penetration points for the formation layers may be incorporated into the predictive model to reduce the chance of model predictability inaccuracies in the next portion of the drilling process. In some cases, it may be desirable to provide faster model iteration updates to provide faster updates to the model and reduce the chance of encountering and expensive oilfield hazard.

It will be further understood that any of the methods described herein may be implemented in full or in part by software, hardware, firmware, or any combination thereof.

This description is intended for purposes of illustration only and should not be construed in a limiting sense. The scope of reservoir engineering should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. A method for performing reservoir engineering, comprising:

generating a geological model of a reservoir including a geological horizon;

obtaining an offset relative to the geological horizon;

positioning a wellbore equipment item in a well completion design based on the offset;

positioning a reservoir operation relative to the geological horizon in the well completion design, wherein the reservoir operation comprises at least one selected from a group consisting of hydraulic fracturing, an oilfield perforation operation, acidization, a chemical treatment, and a cement squeeze;

calculating an absolute position of the wellbore equipment item in the well completion design based on the offset and a location of the geological horizon in the geological model;

updating the geological model to generate an updated location of the geological horizon;

updating the absolute position of the wellbore equipment item in the well completion design based on the offset and the updated location of the geological horizon; and simulating a simulation case comprising the geological model and the well completion design after updating the absolute position of the wellbore equipment item.

2. The method of claim 1, further comprising:

obtaining a tailored rule;

obtaining a parameter for the tailored rule;

generating a custom well control by applying the tailored rule to the parameter, wherein the simulation case further comprises the custom well control.

3. The method of claim 2, wherein the tailored rule is defined by a first user and the parameter is submitted by a second user.

4. The method of claim 2, wherein the tailored rule is defined using a native syntax of a simulator for simulating the simulation case.

5. A reservoir engineering system, comprising:

a processor;

a geological model of a reservoir comprising a geological horizon;

a fluid modeling module comprising functionality to generate a visualization showing surfaces of constant composition or saturation pressure from a fluid and rock model of the reservoir;

a well completion design module comprising functionality to position a wellbore equipment item in a well completion design based on an offset from the geological horizon and to position a reservoir operation relative to the geological horizon in the well completion design, wherein the reservoir operation comprises at least one selected from a group consisting of hydraulic fracturing, an oilfield perforation operation, acidization, a chemical treatment, and a cement squeeze; and a simulation case module, executing on the processor, operatively connected to the fluid modeling module and the well completion module, and comprising functionality to generate a simulation case comprising the geological model, the well completion design, and the fluid and rock model of the reservoir.

6. The reservoir system of claim 5, further comprising:

a rule builder module for defining a tailored rule using native syntax of a simulator;

a well controls module operatively connected to the rule builder module and comprising functionality to apply the tailored rule to a plurality of submitted parameters to generate a custom well control, wherein the simulation case module is operatively connected to the well controls module and the simulation case further comprises the custom well control.

7. The reservoir system of claim 6, wherein the tailored rule is defined by a first user and the parameters are submitted by a second user.

8. The reservoir system of claim 5, further comprising:

an equipment extension module operatively connected to the well completion design module, storing a wellbore equipment model comprising a description of the wellbore equipment item, and comprising functionality to translate the description into simulator-specific instructions for a simulator selected to run the simulation case, wherein the simulation case further comprises the simulator-specific instructions.

9. The reservoir system of claim 8, wherein the equipment model is a plug-in provided by a vendor of the wellbore equipment item.

10. The reservoir system of claim 5, wherein the geological model comprises a geological barrier identified from the visualization showing surfaces of constant composition or saturation pressure.

11. A non-transitory computer readable medium storing instructions for performing reservoir engineering, the instructions comprising functionality to:

generate a geological model of a reservoir including a geological horizon;

generate a model of fluid and rock interactions based on a plurality of fluid samples from the reservoir;

create a three-dimensional (3D) visualization showing surfaces of constant composition or saturation pressure in the reservoir based on the model of fluid and rock interactions;

identify a geological feature from the 3D visualization;

add the geological feature to the geological model of the reservoir;

obtain an offset relative to the geological horizon;

position a wellbore equipment item in a well completion design based on the offset;

calculate an absolute position of the wellbore equipment item in the well completion design based on the offset and a location of the geological horizon in the geological model;

update the geological model to generate an updated location of the geological horizon;

update the absolute position of the wellbore equipment item in the well completion design based on the offset and the updated location of the geological horizon; and simulate a simulation case comprising the geological model, the model of fluid and rock interactions, and the well completion design after updating the absolute position of the wellbore equipment item.

12. The non-transitory computer readable medium of claim 11, the instructions further comprising functionality to:

obtain a wellbore equipment model comprising a description of the wellbore equipment item;

identify a simulator for simulating the simulation case; and translate the description into simulator-specific instructions for the simulator, wherein the simulation case further comprises the simulator-specific instructions.

13. The non-transitory computer readable medium of claim 11, the instructions further comprising functionality to:

obtain a tailored rule;

obtain a parameter for the tailored rule;

generate a custom well control by applying the tailored rule to the parameter, wherein the simulation case further comprises the custom well control, wherein the tailored rule is defined by a first user and the parameter is submitted by a second user.

14. A method for performing reservoir engineering, comprising:

generating a geological model of a reservoir including a geological horizon;

obtaining an offset relative to the geological horizon;

obtaining a wellbore equipment model comprising a description of a wellbore equipment item;

positioning the wellbore equipment item in a well completion design based on the offset;

calculating an absolute position of the wellbore equipment item in the well completion design based on the offset and a location of the geological horizon in the geological model;

updating the geological model to generate an updated location of the geological horizon;

updating the absolute position of the wellbore equipment item in the well completion design based on the offset and the updated location of the geological horizon; and identify a simulator for simulating a simulation case comprising the geological model and the well completion design;

translating the description into simulator-specific instructions for the simulator;

simulating the simulation case comprising the geological model and the well completion design after updating the absolute position of the wellbore equipment item, wherein the simulation case further comprises the simulator-specific instructions, and wherein the wellbore equipment model is provided by a vendor of the wellbore equipment and the model provides a generic interface to an attribute and a function of the wellbore equipment item.

15. A method for performing reservoir engineering, comprising:

generating a geological model of a reservoir including a geological horizon;

collecting a plurality of fluid samples from a plurality of locations in the reservoir;

generating a model of fluid and rock interactions from the plurality of fluid samples;

creating a three-dimensional (3D) visualization showing surfaces of constant composition or saturation pressure in the reservoir based on the model of fluid and rock interactions;

identifying a geological feature from the 3D visualization;

adding the geological feature to the geological model of the reservoir;

obtaining an offset relative to the geological horizon;

positioning a wellbore equipment item in a well completion design based on the offset;

calculating an absolute position of the wellbore equipment item in the well completion design based on the offset and a location of the geological horizon in the geological model;

updating the geological model to generate an updated location of the geological horizon;

updating the absolute position of the wellbore equipment item in the well completion design based on the offset and the updated location of the geological horizon; and simulating a simulation case comprising the geological model and the well completion design after updating the absolute position of the wellbore equipment item, wherein the simulation case further comprises the model of fluid and rock interactions.

16. The method of claim 15, wherein the geological feature is a geological barrier and the plurality of fluid samples originate from a plurality of fluid systems in the reservoir.

* * * * *